US008628384B2

(12) United States Patent
Allison et al.

(10) Patent No.: US 8,628,384 B2
(45) Date of Patent: Jan. 14, 2014

(54) POLISHING PAD FOR EDDY CURRENT END-POINT DETECTION

(75) Inventors: William C. Allison, Beaverton, OR (US); Diane Scott, Portland, OR (US); Ping Huang, Eden Prairie, MN (US); Richard Frentzel, Murrieta, CA (US); Alexander William Simpson, Hillsboro, OR (US)

(73) Assignee: NexPlanar Corporation, Hillsboro, OR (US)

( * ) Notice: Subject to any disclaimer, the term of this patent is extended or adjusted under 35 U.S.C. 154(b) by 428 days.

(21) Appl. No.: 12/895,465

(22) Filed: Sep. 30, 2010

(65) Prior Publication Data

US 2012/0083191 A1 Apr. 5, 2012

(51) Int. Cl.
*B24D 3/28* (2006.01)

(52) U.S. Cl.
USPC ..... 451/526; 451/528; 451/921; 451/6; 451/287

(58) Field of Classification Search
USPC ..... 451/526–539, 285, 287, 4–7, 921; 51/293, 298, 306
See application file for complete search history.

(56) References Cited

U.S. PATENT DOCUMENTS

| | | | | |
|---|---|---|---|---|
| 5,559,428 | A | 9/1996 | Li et al. | |
| 5,624,303 | A * | 4/1997 | Robinson | 451/285 |
| 5,893,796 | A * | 4/1999 | Birang et al. | 451/526 |
| 6,068,539 | A * | 5/2000 | Bajaj et al. | 451/6 |
| 6,072,313 | A | 6/2000 | Li et al. | |
| 6,602,724 | B2 | 8/2003 | Redeker et al. | |
| 6,707,540 | B1 | 3/2004 | Lehman et al. | |
| 6,726,528 | B2 * | 4/2004 | Barbour | 451/6 |
| 6,866,559 | B2 | 3/2005 | Lehman et al. | |
| 6,869,332 | B2 | 3/2005 | Redeker et al. | |
| 6,878,036 | B2 * | 4/2005 | Hanawa et al. | 451/5 |
| 6,878,038 | B2 | 4/2005 | Johansson et al. | |
| 6,924,641 | B1 | 8/2005 | Hanawa et al. | |
| 6,930,478 | B2 | 8/2005 | Hanawa et al. | |
| 6,975,107 | B2 | 12/2005 | Hanawa et al. | |
| 7,001,242 | B2 | 2/2006 | Birang et al. | |
| 7,001,246 | B2 | 2/2006 | Hanawa et al. | |
| 7,008,297 | B2 | 3/2006 | Johansson et al. | |
| 7,029,365 | B2 | 4/2006 | Chang et al. | |
| 7,077,721 | B2 | 7/2006 | Hu et al. | |
| 7,083,497 | B2 | 8/2006 | Halley et al. | |
| 7,112,960 | B2 | 9/2006 | Miller et al. | |
| 7,137,868 | B2 | 11/2006 | Chang et al. | |

(Continued)

FOREIGN PATENT DOCUMENTS

| | | |
|---|---|---|
| EP | 0 941 806 | 9/1999 |
| WO | 2004/009291 | 1/2004 |
| WO | 2006/089293 | 8/2006 |
| WO | 2008/053948 | 5/2008 |

OTHER PUBLICATIONS

International Search Report and Written Opinion from PCT/US2011/053678 mailed Mar. 26, 2012, 11 pgs.

(Continued)

*Primary Examiner* — George Nguyen
(74) *Attorney, Agent, or Firm* — Blakely, Sokoloff, Taylor & Zafman LLP

(57) ABSTRACT

Polishing pads for polishing semiconductor substrates using eddy current end-point detection are described. Methods of fabricating polishing pads for polishing semiconductor substrates using eddy current end-point detection are also described.

11 Claims, 18 Drawing Sheets

(56) References Cited

U.S. PATENT DOCUMENTS

| | | | | |
|---|---|---|---|---|
| 7,153,777 | B2 | 12/2006 | Lee | |
| 7,229,340 | B2 | 6/2007 | Hanawa et al. | |
| 7,285,036 | B2 | 10/2007 | Chang et al. | |
| 7,344,431 | B2 | 3/2008 | Hu et al. | |
| 7,422,516 | B2 | 9/2008 | Butterfield et al. | |
| 7,591,708 | B2 | 9/2009 | Birang et al. | |
| 7,655,565 | B2 | 2/2010 | Manens et al. | |
| 7,670,466 | B2 | 3/2010 | Lee | |
| 2001/0036805 | A1* | 11/2001 | Birang et al. | 451/527 |
| 2003/0171081 | A1* | 9/2003 | Komukai et al. | 451/285 |
| 2003/0236055 | A1 | 12/2003 | Swedek et al. | |
| 2005/0173259 | A1 | 8/2005 | Mavliev et al. | |
| 2005/0194681 | A1 | 9/2005 | Hu et al. | |
| 2006/0009128 | A1 | 1/2006 | Hanawa et al. | |
| 2006/0037699 | A1* | 2/2006 | Nakamori et al. | 156/345.12 |
| 2007/0212976 | A1 | 9/2007 | McReynolds et al. | |
| 2007/0212987 | A1 | 9/2007 | Hanawa et al. | |
| 2008/0020690 | A1 | 1/2008 | Birang et al. | |
| 2008/0047841 | A1 | 2/2008 | Manens et al. | |
| 2008/0064301 | A1 | 3/2008 | Birang et al. | |
| 2008/0242195 | A1* | 10/2008 | Heinrich et al. | 451/6 |
| 2009/0120803 | A9 | 5/2009 | Butterfield et al. | |
| 2009/0305610 | A1 | 12/2009 | Yilmaz et al. | |
| 2011/0171883 | A1* | 7/2011 | Allison et al. | 451/6 |
| 2011/0183579 | A1 | 7/2011 | Newelll | |

OTHER PUBLICATIONS

International Preliminary Report on Patentability from PCT/US2011/053678 mailed Apr. 11, 2013, 7 pgs.

Non-Final Office Action from U.S. Appl. No. 12/895,479 mailed Jun. 20, 2013, 9 pgs.

* cited by examiner

POLISHING PAD FOR EDDY CURRENT END-POINT DETECTION

TECHNICAL FIELD

Embodiments of the present invention are in the field of chemical mechanical polishing (CMP) and, in particular, polishing pads for eddy current end-point detection.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface.

One problem in CMP is determining whether the polishing process is complete, e.g., whether a substrate layer has been planarized to a desired flatness or thickness, or when a desired amount of material has been removed. Over-polishing of a conductive layer or film leads to increased circuit resistance. On the other hand, under-polishing of a conductive layer may lead to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing end-point. Therefore, the polishing end-point often cannot be determined merely as a function of polishing time.

One way to determine the polishing end-point is to monitor polishing of a metal layer on a substrate in-situ, e.g., with optical or electrical sensors. One monitoring technique is to induce an eddy current in the metal layer with a magnetic field, and to detect changes in the magnetic flux as the metal layer is removed. The magnetic flux generated by the eddy current is in opposite direction to the excitation flux lines. This magnetic flux is proportional to the eddy current, which is proportional to the resistance of the metal layer, which is proportional to the layer thickness. Thus, a change in the metal layer thickness results in a change in the flux produced by the eddy current. This change in flux induces a change in current in the primary coil, which can be measured as change in impedance. Consequently, a change in coil impedance reflects a change in the metal layer thickness. However, a polishing pad may have to be altered to accommodate an eddy current measurement during real time polishing of a metal layer on a substrate.

Accordingly, in addition to advances in slurry technology, the polishing pad plays a significant role in increasingly complex CMP operations. However, additional improvements are needed in the evolution of CMP pad technology.

SUMMARY

Embodiments of the present invention include polishing pads for eddy current end-point detection.

In an embodiment, a polishing pad for polishing a semiconductor substrate includes a molded homogeneous polishing body. The molded homogeneous polishing body has a polishing surface and a back surface. The polishing pad also includes an end-point detection region disposed in and covalently bonded with the molded homogeneous polishing body. The end-point detection region is composed of a material different from the molded homogeneous polishing body, at least a portion of which is recessed relative to the back surface of the molded homogeneous polishing body.

In another embodiment, a method of fabricating a polishing pad for polishing a semiconductor substrate includes forming a molded homogeneous polishing body. The molded homogeneous polishing body has a polishing surface and a back surface. The method also includes forming an end-point detection region disposed in and covalently bonded with the molded homogeneous polishing body. The end-point detection region is composed of a material different from the molded homogeneous polishing body, at least a portion of which is recessed relative to the back surface of the molded homogeneous polishing body.

DETAILED DESCRIPTION

Figure 1A:
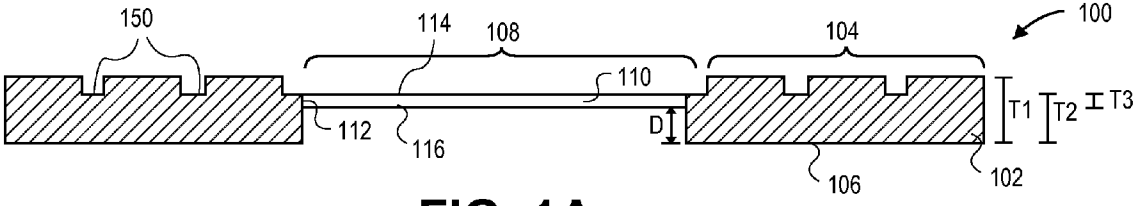
FIG. 1A illustrates a cross-sectional view of a polishing pad for polishing a semiconductor substrate and adapted for eddy current end-point detection, in accordance with an embodiment of the present invention.

Polishing pads for polishing semiconductor substrates using eddy current end-point detection are described herein. In the following description, numerous specific details are set forth, such as specific polishing pad compositions and designs, in order to provide a thorough understanding of embodiments of the present invention. It will be apparent to one skilled in the art that embodiments of the present invention may be practiced without these specific details. In other instances, well-known processing techniques, such as the combination of a slurry with a polishing pad to perform CMP of a semiconductor substrate, are not described in detail in order to not unnecessarily obscure embodiments of the present invention. Furthermore, it is to be understood that the various embodiments shown in the figures are illustrative representations and are not necessarily drawn to scale.

A polishing pad may be formed to include a region designed to accommodate an eddy current detection probe incorporated into a platen of a chemical mechanical polishing apparatus. For example, in an embodiment of the present invention, a distinct material region is included in a polishing pad during molding of the polishing pad. The distinct material region is shaped and sized to accommodate an eddy current probe that protrudes from a platen. Furthermore, the region can be made at least somewhat transparent to aid with aligning a polishing pad onto the platen which includes the eddy current probe. In another embodiment of the present invention, a polishing pad is entirely a molded homogeneous polishing body with a recess formed in a region of the back side of the polishing body. The recess may also be shaped and sized to accommodate an eddy current probe that produces from a platen. In one embodiment, a single recess is sized to accommodate all portions of an eddy current detector that protrude above a platen. Additionally, in the case that the molded homogeneous polishing body is opaque, a pattern may be formed in the polishing surface of the polishing pad where the pattern is indicative of, or is a key to, the location of the recess on the back side of the polishing pad. The key may be used to aid with aligning a polishing pad onto the platen which includes the eddy current probe.

In accordance with an embodiment of the present invention, a polishing pad for polishing a semiconductor substrate is provided to allow for an apparatus such as sensor to extend above platen of a CMP tool. For example, in one embodiment, a polishing pad includes design features to facilitate its use on polishing tools fitted with eddy current end-point detection systems and in CMP processes utilizing eddy current end-point detection. The polishing pad design features may generally allow for the eddy current sensor of the CMP tool to rise above the plane of the CMP tool platen and extend into the backside of the polishing pad while a polishing process is in progress. In an embodiment, the design features allow this to occur without impacting the overall polishing performance of the polishing pad. The design features may also allow for the placement of the polishing pad on the platen in a correct orientation such that the eddy current sensor can rise above the plane of the platen without interference.

In an embodiment, a design feature includes a recess in the backside of a polishing pad appropriately sized, shaped and positioned to align with an eddy current sensor. In an embodiment, another design feature includes a means of visually orienting the polishing pad on the platen to align with a location of a sensor, such as an eddy current sensor. In one embodiment, a polishing pad has a transparent portion. In another embodiment, a polishing pad is entirely opaque but includes a visible signal or key, such as an interrupted pattern on its polishing surface, indicating the location of a corresponding backside recess.

Figure 1B:
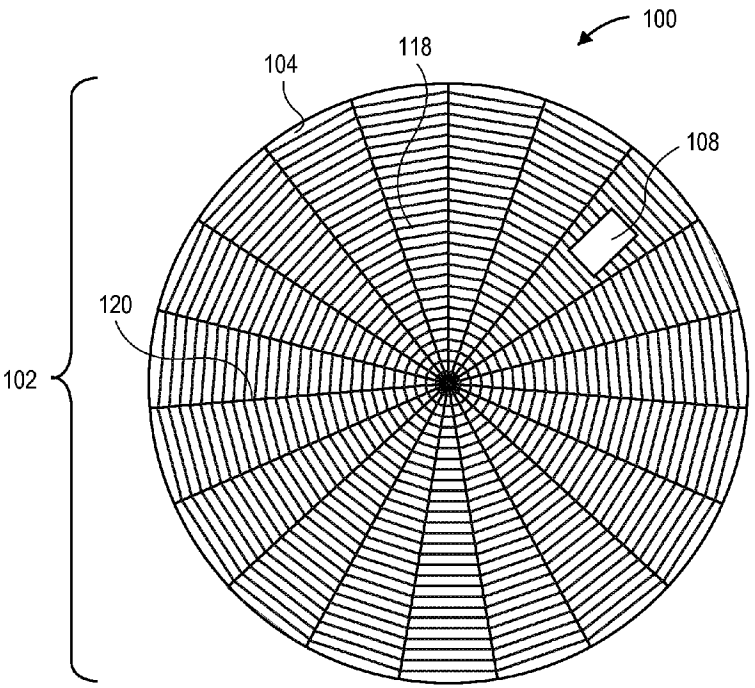
FIG. 1B illustrates a top-down view of the polishing pad of FIG. 1A, in accordance with an embodiment of the present invention.

In an aspect of the present invention, a polishing pad for use with eddy current detection includes an end-point detection region composed of a material different from the rest of the polishing pad. For example, FIG. 1A illustrates a cross-sectional view of a polishing pad adapted for eddy current end-point detection, in accordance with an embodiment of the present invention. FIG. 1B illustrates a top-down view of the polishing pad of FIG. 1A, in accordance with an embodiment of the present invention.

Referring to FIGS. 1A and 1B, a polishing pad 100 includes a molded homogeneous polishing body 102. The molded homogeneous polishing body 102 has a polishing surface 104 and a back surface 106 (note that back surface 106 is only depicted in FIG. 1A). The polishing surface 104 may include a plurality of grooves 150, as depicted in FIG. 1. An end-point detection region 108 is disposed in the molded homogeneous polishing body 102. The end-point detection region 108 is composed of a material 110 different from the molded homogeneous polishing body 102. The material 110 is covalently bonded 112 with the material of molded homogeneous polishing body 102.

In an embodiment, end-point detection region 108 is thinner than the majority of the polishing pad, with or without the grooves, as depicted in FIG. 1A. For example, in one embodiment, the thickness (T3) of the material 110 of end-point detection region 108 is thinner than the thickness (T1) of the molded homogeneous polishing body 102. And, in particular, T3 is thinner than the thickness (T2) of the portion of the molded homogeneous polishing body 102 excluding the grooves 150 of the polishing surface 104. In a specific embodiment, T1 is the thinnest portion of polishing pad 100.

Referring again to FIG. 1A, at least a portion the material 110 of end-point detection region 108 is recessed relative to the back surface 106 of the molded homogeneous polishing body 102. For example, in an embodiment, the material 110 of the end-point detection region 108 is entirely recessed relative to the back surface 106 of the molded homogeneous polishing body 102. In particular, the material 110 of the end-point detection region 108 has a first surface 114 and a second surface 116. The second surface 116 is recessed by an amount D relative to the back surface 106. In an embodiment, the second surface 116 is recessed by an amount D sufficient to accommodate an eddy current probe protruding from a platen of a chemical mechanical polishing apparatus. In a specific embodiment, the recessed depth D is approximately 70 mils (thousandths of an inch) below surface 106.

Referring to FIG. 1B, in an embodiment, the polishing surface 104 of the molded homogeneous polishing body 102 has a pattern of grooves disposed therein, i.e. a pattern formed from grooves 150 shown in FIG. 1A. In one embodiment, the pattern of grooves includes a plurality of concentric polygons 118 along with a plurality of radial lines 120, as depicted in FIG. 1B.

In an embodiment, the term "covalently bonded" refers to arrangements where atoms from the material 110 of end-point detection region 108 are cross-linked or shares electrons with atoms from the molded homogeneous polishing body 102 to effect actual chemical bonding. Such covalent bonding is distinguished from electrostatic interactions that may result if a portion of a polishing pad is cut out and replaced with an insert region, such as a window insert. Covalent bonding is also distinguished from mechanical bonding, such as bonding through screws, nails, glues, or other adhesives. As described in detail below, the covalent bonding may be achieved by curing a polishing body precursor with an end-point detection region precursor already disposed therein, as opposed to through separate formation of a polishing body and a later-added insert.

Figure 2A:
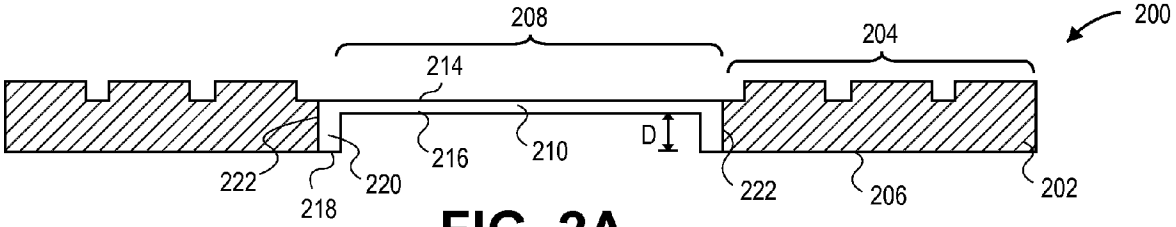
FIG. 2A illustrates a cross-sectional view of a polishing pad for polishing a semiconductor substrate and adapted for eddy current end-point detection, in accordance with an embodiment of the present invention.
Figure 2B:
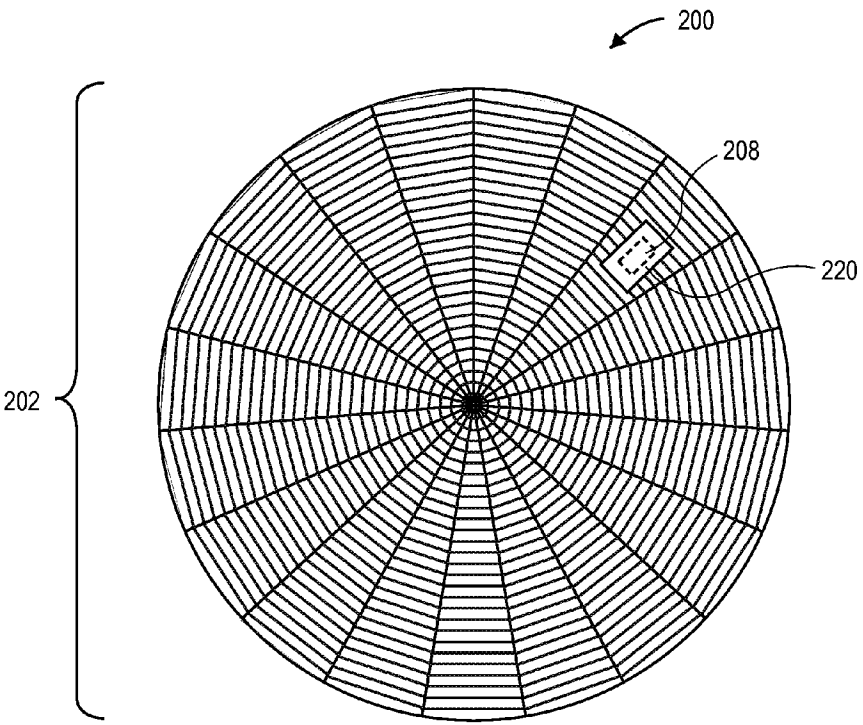
FIG. 2B illustrates a top-down view of the polishing pad of FIG. 2A, in accordance with an embodiment of the present invention.

In another embodiment, the material of an end-point detection region is not entirely recessed relative to the back surface of a molded homogeneous polishing body. For example, FIG. 2A illustrates a cross-sectional view of another polishing pad, in accordance with another embodiment of the present invention. FIG. 2B illustrates a top-down view of the polishing pad of FIG. 2A, in accordance with an embodiment of the present invention.

Referring to FIGS. 2A and 2B, a polishing pad 200 includes a molded homogeneous polishing body 202. The molded homogeneous polishing body 202 has a polishing surface 204 and a back surface 206 (note that back surface 206 is only depicted in FIG. 2A). An end-point detection region 208 is disposed in the molded homogeneous polishing body 202. The end-point detection region 208 is composed of a material 210 different from the molded homogeneous polishing body 202. The material 210 is covalently bonded 212 with the material of molded homogeneous polishing body 202.

In an embodiment, only a portion the material 210 of end-point detection region 208 is recessed relative to the back surface 206 of the molded homogeneous polishing body 202. For example, the material 210 of the end-point detection region 208 has a first surface 214, a second surface 216, and a third surface 218. The second surface includes only an inner portion of end-point detection region 208 and is recessed by an amount D relative to the back surface 206 of molded homogeneous polishing body 202 and to the third surface 218 of the end-point detection region 208. As such, sidewalls 220 of end-point detection region 208 remain along the interfaces 222 where end-point detection region 208 and the molded homogeneous polishing body 202 meet.

In one embodiment, by retaining sidewalls 220, a greater extent of covalent bonding between end-point detection region 208 and the molded homogeneous polishing body 202 is achieved, increasing the integrity of polishing pad 200. In an embodiment, the second surface 216 is recessed by an amount D sufficient to accommodate an eddy current probe protruding from a platen of a chemical mechanical polishing apparatus. In a specific embodiment, the recessed depth D is approximately 70 mils (thousandths of an inch) below surface 206.

Referring to FIGS. 1A, 1B, 2A, and 2B, in accordance with an embodiment of the present invention, the end-point detection region (e.g., region 108 or 208) is a local area transparency (LAT) region. In an embodiment, a molded homogeneous polishing body is opaque, while a LAT region is not opaque. In one embodiment, a molded homogeneous polishing body is opaque due at least in part to inclusion of an inorganic substance in the material used in its fabrication, as described below. In that embodiment, a LAT region is fabricated exclusive of the inorganic substance and is substantially, if not totally, transparent to, e.g., visible light, ultraviolet light, infra-red light, or a combination thereof. In a specific embodiment, the inorganic substance included in a molded homogeneous polishing body is an opacifying lubricant, whereas a LAT region does not contain any inorganic materials, and is essentially free from the opacifying lubricant.

In an embodiment, a LAT region is effectively transparent (ideally totally transparent) in order to enable transmission of light through a polishing pad for, e.g., positioning a polishing pad on a platen or for end-point detection. However, it may be the case that a LAT region cannot or need not be fabricated to be perfectly transparent, but may still be effective for transmission of light for positioning a polishing pad on a platen or for end-point detection. For example, in one embodiment, a LAT region less than 80% of incident light in the 700-710 nanometer range, but is still suitable to act as a window within a polishing pad. In an embodiment, the above described LAT regions are impermeable to slurry used in a chemical mechanical polishing operation.

In an embodiment, referring again to FIGS. 1B and 2B, end-point detection regions 108 and 208, respectively, are LAT regions and are visibly transparent in a top-down view. In one embodiment, this visible transparency aids in mounting a polishing pad on a platen equipped with an eddy current detection probe. In FIG. 2B, sidewalls 220 are visible from this perspective, as depicted by the dashed rectangular shape.

In another embodiment, however, the material of an end-point detection region is opaque and thus does not act to provide a local area transparency region. For example, FIGS. 3A and 3B illustrate cross-sectional views of other polishing pad, in accordance with another embodiment of the present invention.

Figure 3A:
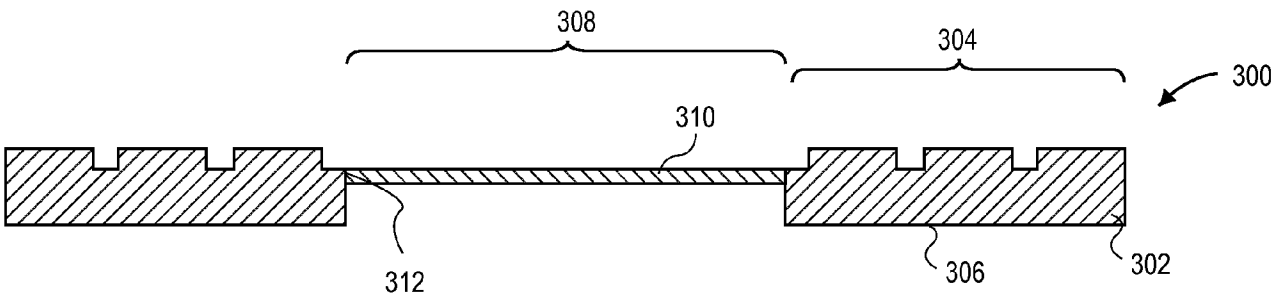
FIG. 3A illustrates a cross-sectional view of a polishing pad for polishing a semiconductor substrate and adapted for eddy current end-point detection, in accordance with an embodiment of the present invention.
Figure 3B:
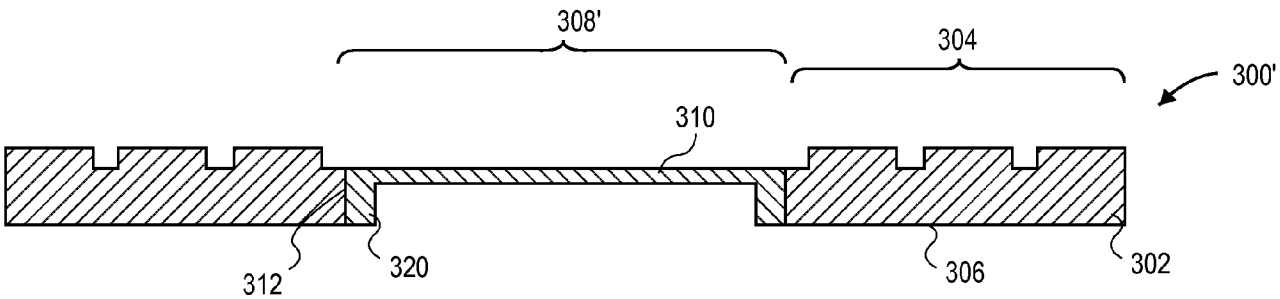
FIG. 3B illustrates a cross-sectional view of a polishing pad for polishing a semiconductor substrate and adapted for eddy current end-point detection, in accordance with an embodiment of the present invention.

Referring to FIGS. 3A and 3B, a polishing pad 300 (or 300') includes a molded homogeneous polishing body 302. The molded homogeneous polishing body 302 has a polishing surface 304 and a back surface 306. An end-point detection region 308 (or 308') is disposed in the molded homogeneous polishing body 302. The end-point detection region 308 (or 308') is composed of an opaque material 310 different from the molded homogeneous polishing body 302. The material 310 is covalently bonded 312 with the material of molded homogeneous polishing body 302.

In an embodiment, referring to FIG. 3A, the material 310 of the end-point detection region 308 is entirely recessed relative to the back surface 306 of the molded homogeneous polishing body 302. In another embodiment, referring to FIG. 3B, only a portion the material 310 of end-point detection region 308' is recessed relative to the back surface 306 of the molded homogeneous polishing body 302, leaving sidewalls 320. In an embodiment, the end-point detection region 308 (or 308') is an opaque region having a hardness different from the hardness of the molded homogeneous polishing body 302. In a specific embodiment, the hardness of the end-point detection region 308 (or 308') is greater than the hardness of the molded homogeneous polishing body 302. However, in an alternative embodiment, the hardness of the end-point detection region 308 (or 308') is less than the hardness of the molded homogeneous polishing body 302. In an embodiment, end-point detection region 308 (or 308') is impermeable to slurry used in a chemical mechanical polishing operation.

Although end-point detection region 308 (or 308') is composed of an opaque material 310, the region may still be used to visually mount polishing pad 300 or 300', respectively, on a platen equipped with an eddy current probe. For example, in one embodiment, the absence of a grooved pattern on the first surface 304 of end-point detection region 308 (or 308') provides for a visual indication or key of the location of end-point detection region 308 (or 308').

Figure 4A:
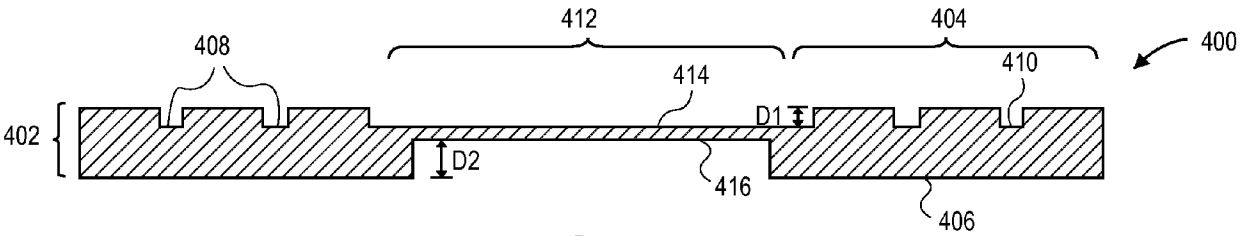
FIG. 4A illustrates a cross-sectional view of a polishing pad for polishing a semiconductor substrate and adapted for eddy current end-point detection, in accordance with an embodiment of the present invention.
Figure 4B:
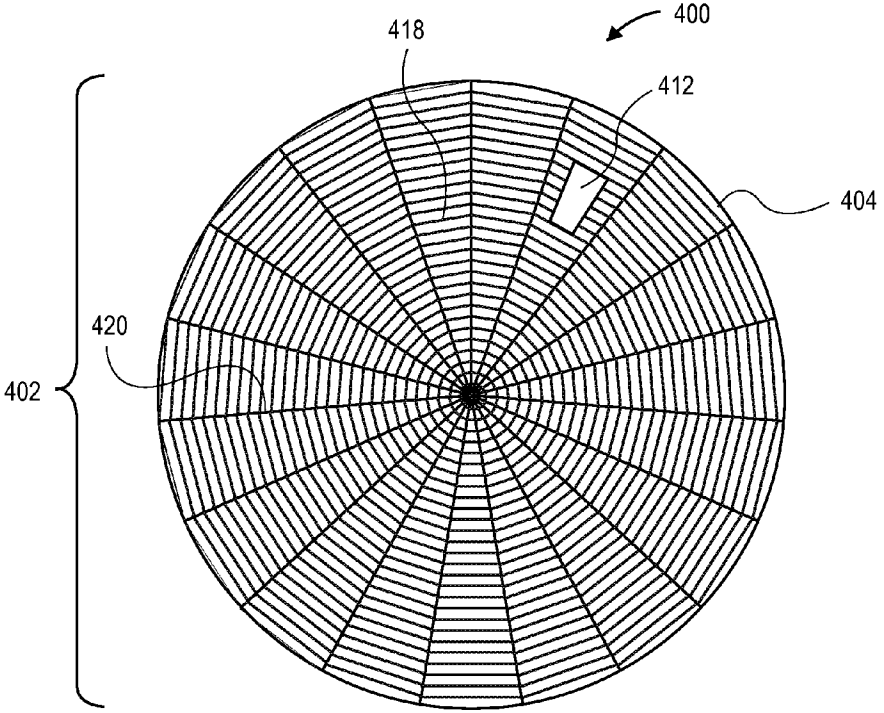
FIG. 4B illustrates a top-down view of the polishing pad of FIG. 4A, in accordance with an embodiment of the present invention.

In another aspect of the present invention, a polishing pad for use with eddy current detection includes an end-point detection region composed of the same material and is homogeneous with the rest of the polishing pad. FIG. 4A illustrates a cross-sectional view of a polishing pad for polishing a semiconductor substrate and adapted for eddy current end-point detection, in accordance with an embodiment of the present invention. FIG. 4B illustrates a top-down view of the polishing pad of FIG. 4A, in accordance with an embodiment of the present invention.

Referring to FIGS. 4A and 4B, a polishing pad 400 includes a molded homogeneous polishing body 402. The molded homogeneous polishing body 402 has a polishing surface 404 and a back surface 406. A pattern of grooves 408 is disposed in the polishing surface 404. Each groove of the pattern of grooves has a bottom depth 410. The polishing pad 400 also includes an end-point detection region 412 formed in the molded homogeneous polishing body 402. The end-point detection region has a first surface 414 oriented with the polishing surface 404, and a second surface 416 oriented with the back surface 406. At least a portion of the first surface 414 is co-planar with the bottom depth 410 of the pattern of grooves, e.g., by a depth D1. The second surface 416 is recessed into the molded homogeneous polishing body 402 relative to the back surface 406 by an amount D2. In an embodiment, the second surface 416 is recessed by an amount D2 sufficient to accommodate an eddy current probe protruding from a platen of a chemical mechanical polishing apparatus. In a specific embodiment, the recessed depth D2 is approximately 70 mils (thousandths of an inch) below surface 406. In an embodiment, since at least a portion of the first surface 414 is co-planar with the bottom depth 410 of the pattern of grooves, first surface 414 does not interfere with slurry movement during polishing of a wafer.

In an embodiment, at least a portion of the first surface 414 interrupts the pattern of grooves 408 of the polishing surface 404. For example, in one embodiment, referring to FIG. 4A, the entire first surface 414 of the end-point detection region 412 is essentially co-planar with the bottom depth 410 of the pattern of grooves 408. As such, the pattern of grooves 408 is interrupted at end-point detection region 412 since, effectively, a single large groove is formed on the first surface 414 of the end-point detection region 412. Referring again to FIG. 4B, the polishing surface 404 of the molded homogeneous polishing body 402 has a pattern of grooves disposed therein. In one embodiment, the pattern of grooves includes a plurality of concentric polygons 418 along with a plurality of radial lines 420. However, at end-point detection region 412, the pattern is interrupted due to the absence of grooves.

Accordingly, a visual indicator of the location of end-point detection region 412 is provided, even though end-point detection region 412 is composed of the same material as molded homogeneous polishing body 402. In a specific embodiment, the molded homogeneous polishing body 402, including the end-point detection region 408, is opaque but the interruption ion the pattern of grooves is used for visual determination of the location of end-point detection region 408 for mounting on a platen equipped with an eddy current detection system.

Figure 5A:
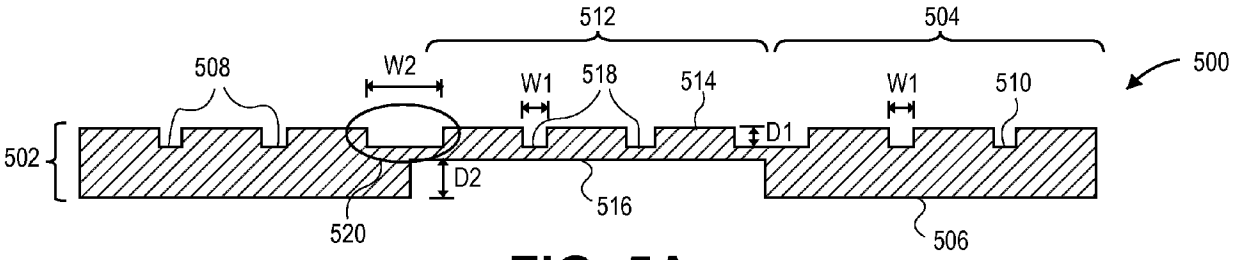
FIG. 5A illustrates a cross-sectional view of a polishing pad for polishing a semiconductor substrate and adapted for eddy current end-point detection, in accordance with an embodiment of the present invention.
Figure 5B:
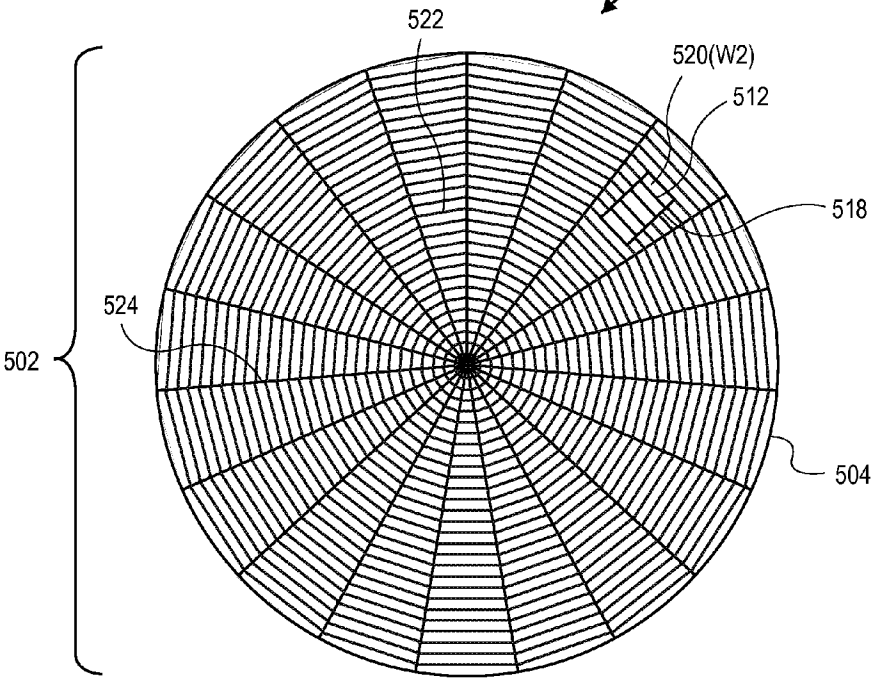
FIG. 5B illustrates a top-down view of the polishing pad of FIG. 5A, in accordance with an embodiment of the present invention.

In another embodiment, an end-point detection region has a second pattern of grooves having a depth essentially co-planar with the bottom depth of the pattern of grooves disposed in a polishing surface of a polishing pad. For example, FIG. 5A illustrates a cross-sectional view of another polishing pad, in accordance with another embodiment of the present invention. FIG. 5B illustrates a top-down view of the polishing pad of FIG. 5A, in accordance with an embodiment of the present invention.

Referring to FIGS. 5A and 5B, a polishing pad 500 includes a molded homogeneous polishing body 502. The molded homogeneous polishing body 502 has a polishing surface 504 and a back surface 506. A pattern of grooves 508 is disposed in the polishing surface 504. Each groove of the pattern of grooves has a bottom depth 510. The polishing pad 500 also includes an end-point detection region 512 formed in the molded homogeneous polishing body 502. The end-point detection region has a first surface 514 oriented with the polishing surface 504, and a second surface 516 oriented with the back surface 506. At least a portion of the first surface 514 is co-planar with the bottom depth 510 of the pattern of grooves, e.g., by a depth D1. The second surface 516 is recessed into the molded homogeneous polishing body 502 relative to the back surface 506 by an amount D2. In an embodiment, the second surface 516 is recessed by an amount D2 sufficient to accommodate an eddy current probe protruding from a platen of a chemical mechanical polishing apparatus. In a specific embodiment, the recessed depth D2 is approximately 70 mils (thousandths of an inch) below surface 506.

In an embodiment, at least a portion of the first surface 514 interrupts the pattern of grooves 508 of the polishing surface 504. For example, in one embodiment, referring to FIG. 5A, the first surface 514 of the end-point detection region 512 has a second pattern of grooves 518 with a depth essentially co-planar with the bottom depth (e.g., to a depth D1) of the pattern of grooves 508 disposed in the polishing surface 504. However, the pattern of grooves 508 of the polishing surface 504 and the second pattern of grooves 518 of end-point detection region 512 are interrupted by a change in spacing 520. For example, individual grooves of both the pattern of grooves 508 and the second pattern of grooves 518 are spaced apart by a width W1, and the second pattern of grooves 518 is offset from the first pattern of grooves 508 by a distance W2 greater than the width W1.

Referring again to FIG. 5B, the polishing surface 504 of the molded homogeneous polishing body 502 has a pattern of grooves disposed therein. In one embodiment, the pattern of grooves includes a plurality of concentric polygons 522 along with a plurality of radial lines 524. However, at end-point detection region 512, the pattern is interrupted around the second pattern of grooves 518. Accordingly, a visual indicator of the location of end-point detection region 512 is provided, even though end-point detection region 512 is composed of the same material as molded homogeneous polishing body 502. In a specific embodiment, the molded homogeneous polishing body 502, including the end-point detection region 508, is opaque but the interruption in the pattern of grooves is used for visual determination of the location of end-point detection region 508 for mounting on a platen equipped with an eddy current detection system.

The use of an interruption in a pattern of grooves for visual determination of the location of an end-point detection region for mounting on a platen equipped with an eddy current detection system is not limited to embodiments where an offset in the groove pattern indicates the location of the end-point detection region on the back side of a polishing pad, as described above. In another embodiment, an additional groove is included on the polishing surface to trace the outline of the location of the detection region on the back side of the polishing pad. In another embodiment, a change is groove width is used on the polishing surface to indicate the location of the detection region on the back side of the polishing pad. In another embodiment, a change is groove pitch is used on the polishing surface to indicate the location of the detection region on the back side of the polishing pad. In another embodiment, two or more of the above features is included on the polishing surface to indicate the location of the detection region on the back side of the polishing pad.

In accordance with an embodiment of the present invention, the molded homogeneous polishing bodies described above are composed of a thermoset, closed cell polyurethane material. In an embodiment, the term "homogeneous" is used to indicate that the composition of a thermoset, closed cell polyurethane material is consistent throughout the entire composition of the polishing body. For example, in an embodiment, the term "homogeneous" excludes polishing pads composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and freezes to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. In an embodiment, the term "molded" is used to indicate that a molded homogeneous polishing body is formed in a formation mold, as described in more detail below.

In an embodiment, the polishing bodies described above are opaque. In one embodiment, the term "opaque" is used to indicate a material that allows approximately 10% or less visible light to pass. In one embodiment, a molded homogeneous polishing body is opaque in most part, or due entirely to, the inclusion of an opacifying lubricant throughout (e.g., as an additional component in) the homogeneous thermoset, closed cell polyurethane material of a molded homogeneous polishing body. In a specific embodiment, the opacifying lubricant is a material such as, but not limited to: boron nitride, cerium fluoride, graphite, graphite fluoride, molybdenum sulfide, niobium sulfide, talc, tantalum sulfide, tungsten disulfide, or Teflon.

In an embodiment, a molded homogeneous polishing body includes porogens. In one embodiment, the term "porogen" is used to indicate micro- or nano-scale spherical particles with "hollow" centers. The hollow centers are not filled with solid material, but may rather include a gaseous or liquid core. In one embodiment, a molded homogeneous polishing body includes as porogens pre-expanded and gas-filled EXPANCEL throughout (e.g., as an additional component in) the homogeneous thermoset, closed cell polyurethane material of a molded homogeneous polishing body. In a specific embodiment, the EXPANCEL is filled with pentane.

The sizing of a molded homogeneous polishing body may be varied according to application. Nonetheless, certain parameters may be used to make polishing pads including such a molded homogeneous polishing body compatible with conventional processing equipment or even with conventional chemical mechanical processing operations. For example, in accordance with an embodiment of the present invention, a molded homogeneous polishing body has a thickness approximately in the range of 0.075 inches to 0.130 inches, e.g., approximately in the range of 1.9-3.3 millimeters. In one embodiment, a molded homogeneous polishing body 202 has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters. In one embodiment, a molded homogeneous polishing body has a pore density approximately in the range of 18%-30% total void volume, and possibly approximately in the range of 15%-35% total void volume. In one embodiment, a molded homogeneous polishing body has a porosity of the closed cell type. In one embodiment, a molded homogeneous polishing body has a pore size of approximately 40 micron diameter, but may be smaller, e.g., approximately 20 microns in diameter. In one embodiment, a molded homogeneous polishing body has a compressibility of approximately 2.5%. In one embodiment, a molded homogeneous polishing body has a density approximately in the range of 0.70-0.90 grams per cubic centimeter, or approximately in the range of 0.95-1.05 grams per cubic centimeter.

Removal rates of various films using a polishing pad, including molded homogeneous polishing body, for eddy current detection may vary depending on polishing tool, slurry, conditioning, or polish recipe used. However, in one embodiment, a molded homogeneous polishing body exhibits a copper removal rate approximately in the range of 30-900 nanometers per minute. In one embodiment, a molded homogeneous polishing body as described herein exhibits an oxide removal rate approximately in the range of 30-900 nanometers per minute.

As noted above, a polishing pad adapted for eddy current detection may be fabricated in a molding process. In an embodiment, a molding process may be used to fabricate a polishing pad with an end-point detection region composed of a material different from the rest of the polishing pad. For example, FIGS. 6A-6J illustrate cross-sectional views of various process operations in the fabrication of a polishing pad for polishing a semiconductor substrate and adapted for eddy current end-point detection, in accordance with an embodiment of the present invention.

Figure 6A:
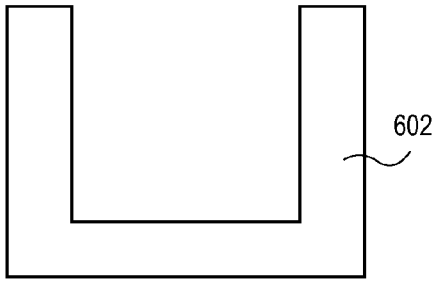
FIGS. 6A-6T illustrate cross-sectional views of operations used in the fabrication of a polishing pad, in accordance with an embodiment of the present invention.
Figure 6B:
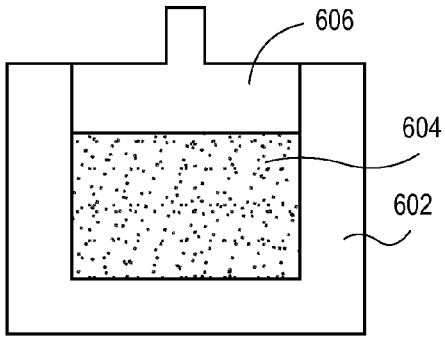
Figure 6C:
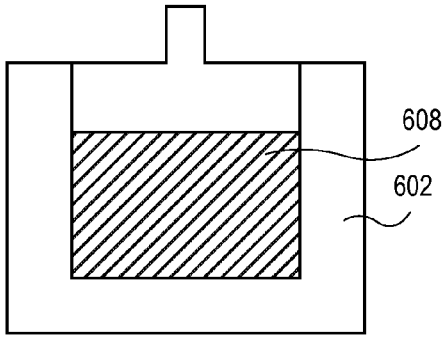
Figure 6D:
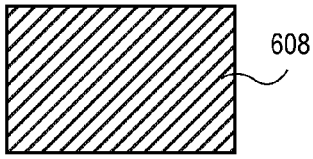

Referring to FIGS. 6A-6D, a method of fabricating a polishing pad includes first forming a partially cured end-point detection region precursor. For example, referring to FIGS. 6A and 6B, a first formation mold 602 is filled with a precursor mixture 604 and a lid 606 of the first formation mold 602 is placed on top of the mixture 604. In an embodiment, with the lid 606 in place, the mixture 604 is heated under pressure to provide a partially cured body 608 (e.g., at least some extent of chain extension and/or cross-linking formed throughout the mixture 604, as depicted in FIG. 6C). Upon removal of the partially cured body 608 from the first formation mold 602, a partially cured end-point detection region precursor 608 is provided, as depicted in FIG. 6D.

In an embodiment, the partially cured end-point detection region precursor 608 is formed by mixing a urethane pre-polymer with a curative. In one embodiment, the partially cured end-point detection region precursor 608 ultimately provides a local area transparency (LAT) region in a polishing pad. The LAT region may be composed of a material compatible with various end-point detection techniques and suitable for inclusion in a polishing pad fabricated by a molding process. For example, the partially cured end-point detection region precursor 608 is formed by first mixing an aromatic urethane pre-polymer with a curative. In another embodiment, an opaque region is formed by including an opacifying agent in the mixture. In either case, the resulting mixture is then partially cured in the first formation mold to provide a molded gel.

Figure 6E:
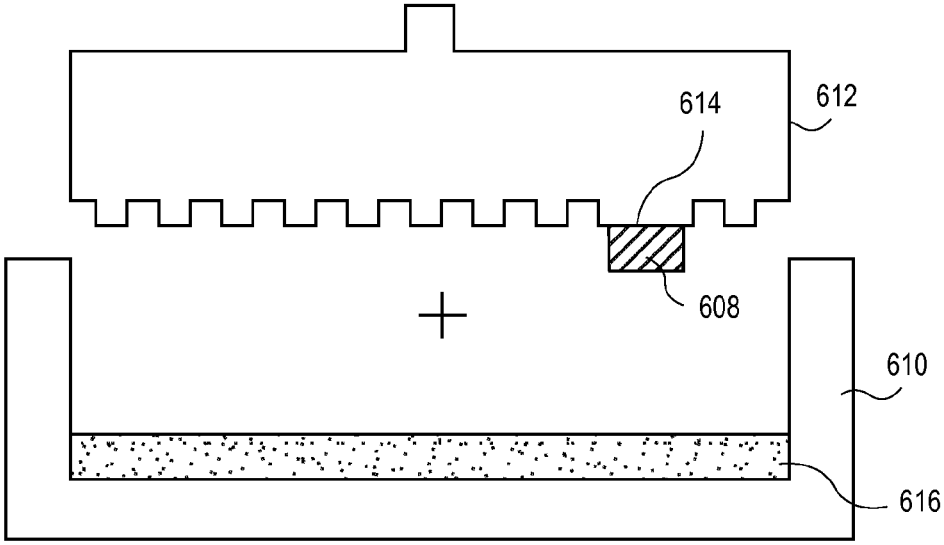

Referring to FIG. 6E, the partially cured end-point detection region precursor 608 is positioned on a receiving region 614 of a lid 612 of a second formation mold 610. A polishing pad precursor mixture 616 is formed in the second formation mold 610. In accordance with an embodiment of the present invention, the polishing pad precursor mixture 616 includes a polyurethane pre-polymer and a curative.

In an embodiment, the polishing pad precursor mixture 616 is used to ultimately form a molded homogeneous polishing body composed of a thermoset, closed cell polyurethane material. In one embodiment, the polishing pad precursor mixture 616 is used to ultimately form a hard pad and only a single type of curative is used. In another embodiment, the polishing pad precursor mixture 616 is used to ultimately form a soft pad and a combination of a primary and a secondary curative is used. For example, in a specific embodiment, the pre-polymer includes a polyurethane precursor, the primary curative includes an aromatic diamine compound, and the secondary curative includes an ether linkage. In a particular embodiment, the polyurethane precursor is an isocyanate, the primary curative is an aromatic diamine, and the secondary curative is a curative such as, but not limited to, polytetramethylene glycol, amino-functionalized glycol, or amino-functionalized polyoxypropylene. In an embodiment, pre-polymer, a primary curative, and a secondary curative have an approximate molar ratio of 100 parts pre-polymer, 85 parts primary curative, and 15 parts secondary curative. It is to be understood that variations of the ratio may be used to provide polishing pads with varying hardness values, or based on the specific nature of the pre-polymer and the first and second curatives. In an embodiment, the mixing further includes mixing an opacifying lubricant with the pre-polymer, the primary curative, and the secondary curative. In an embodiment, the opacifying agent is a material such as, but not limited to: boron nitride, cerium fluoride, graphite, graphite fluoride, molybdenum sulfide, niobium sulfide, talc, tantalum sulfide, tungsten disulfide, or Teflon.

In a specific embodiment, a molded homogeneous polishing body is fabricated by reacting (a) an aromatic urethane pre-polymer, such as AIRTHANE 60D: polytetramethylene glycol-toluene diisocyanate, (b) a porogen, such as EXPANCEL DE40: acrylonitrile/acrylate copolymer with an isobutene or pentane filler, (c) a lubricant and whiting agent filler (d) a polyol, such as Terathane 2000: polyoxytetramethylene glycol, and (e) a catalyst, such as DABCO 1027 with (f) a curative, such as CURENE 107: thioether aromatic diamine, (g) a thermal stabilizer, such as Irgastab PUR68, and (g) a UV absorber, such as Tinuvin 213 to form a nearly opaque buff-colored thermoset polyurethane having a substantially uniform microcellular, closed cell structure. In one embodiment, EXPANCEL is filled with a gas and the average pore size of each EXPANCEL unit is approximately in the range of 20 to 40 microns.

Figure 6F:
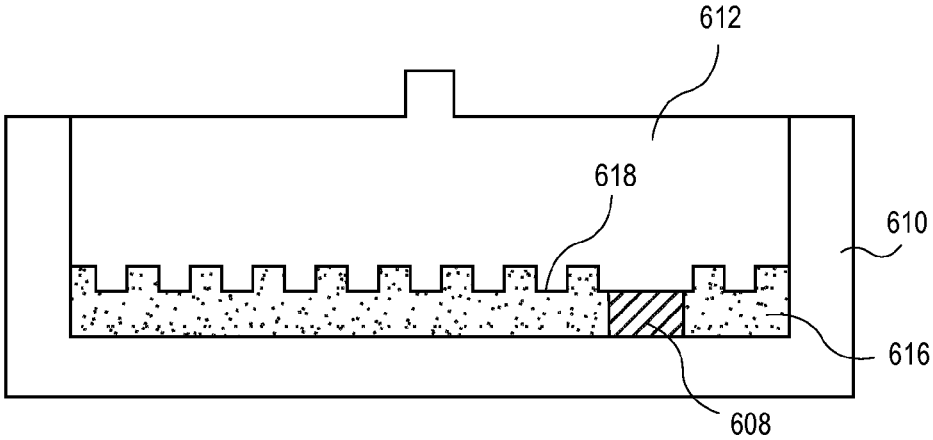

Referring to FIG. 6F, the partially cured end-point detection region precursor 608 is moved into the polishing pad precursor mixture 616 by lowering the lid 612 of the second formation mold 610. In an embodiment, the partially cured end-point detection region precursor 608 is moved to the very bottom surface of the second formation mold 610, as depicted in FIG. 6F. In an embodiment, a plurality of grooves is formed in the lid 612 of formation mold 612. The plurality of grooves is used to stamp a pattern of grooves into a polishing surface of a polishing pad formed in formation mold 610. It is to be understood that embodiments described herein that describe moving a partially cured end-point detection region precursor into a polishing pad precursor mixture by lowering the lid of a formation mold need only achieve a bringing together of the lid and a base of the formation mold. That is in some embodiments, a base of a formation mold is raised toward a lid of a formation mold, while in other embodiments a lid of a formation mold is lowered toward a base of the formation mold at the same time as the base is raised toward the lid.

Figure 6G:
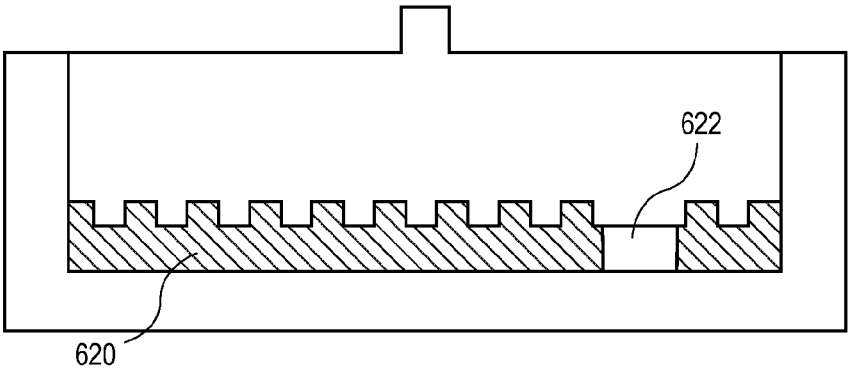
Figure 6H:
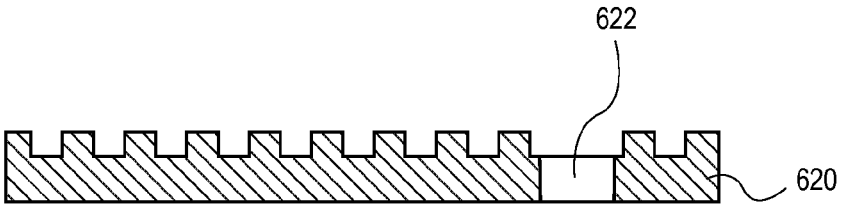

Referring to FIG. 6G, the polishing pad precursor mixture 616 and the partially cured end-point detection region precursor 608 are heated under pressure (e.g., with the lid 612 in place) to provide a molded homogeneous polishing body 620 covalently bonded with a cured end-point detection region precursor 622. Referring to FIG. 6H, a polishing pad (or polishing pad precursor, if further curing is required) is removed from mold 610 to provide a molded homogeneous polishing body 620 with a cured end-point detection region precursor 622 disposed therein. It is noted that further curing through heating may be desirable and may be performed by placing the polishing pad in an oven and heating. Either way, a polishing pad is ultimately provided, wherein molded homogeneous polishing body 620 of the polishing pad has a polishing surface (top, grooved surface of FIG. 6H) and a back surface (bottom, flat surface of FIG. 6H). In an embodiment, heating in the formation mold 610 includes at least partially curing prior in the presence of lid 612, which encloses mixture 616 in formation mold 610, at a temperature approximately in the range of 200-260 degrees Fahrenheit and a pressure approximately in the range of 2-12 pounds per square inch.

Figure 6I:
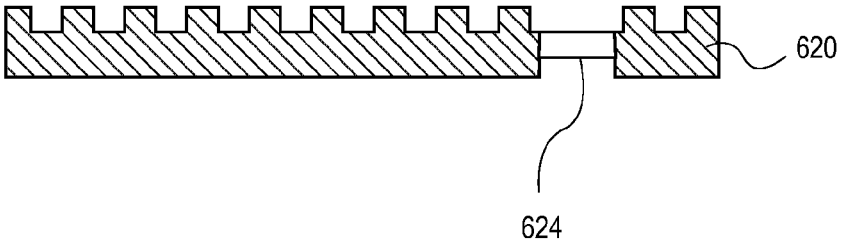
Figure 6J:
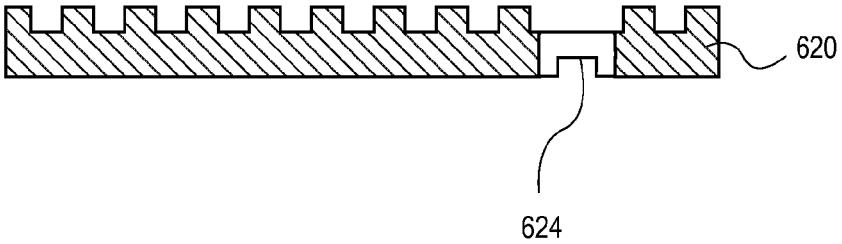
Figure 6K:
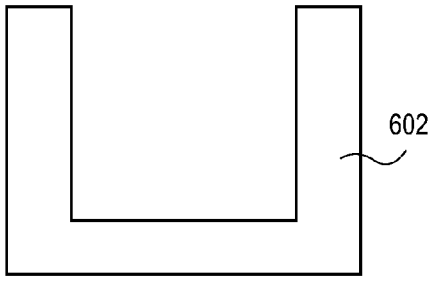
Figure 6L:
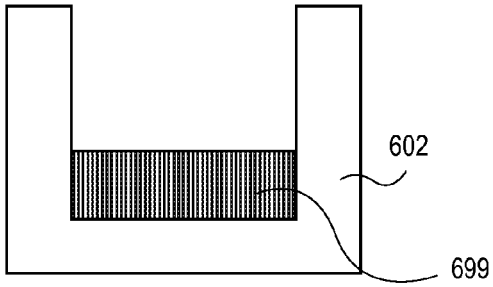

Finally, referring to FIGS. 6I and 6J, the cured end-point detection region precursor 622 is recessed relative to the back surface of the molded homogeneous polishing body 620. The recessing provides a polishing pad an end-point detection region 624 disposed in and covalently bonded with the molded homogeneous polishing body 620. For example, polishing pads that may be obtained in the above manner may include, but are not limited to, the polishing pads described in association with FIGS. 1A and 1B, 2A and 2B, 3A, and 3B.

In accordance with an embodiment of the present invention, the recessing of cured end-point detection region precursor 622 is performed by routing out a portion of the cured end-point detection region precursor 622. In one embodiment, the entire end-point detection region 624 is recessed relative to the back surface of the molded homogeneous polishing body 620, as depicted in FIG. 6I and described in association with FIGS. 1A, 1B and 3A. In another embodiment, however, only an inner portion of the end-point detection region 624 is recessed relative to the back surface of the molded homogeneous polishing body, as depicted in FIG. 6J and described in association with FIGS. 2A, 2B and 3B.

In another aspect, a molding process may be used to fabricate a polishing pad with an end-point detection region composed of a material different from the rest of the polishing pad. However, the material used for the end-point detection region may be introduced into the molding process on a separate support structure that needs to be accommodated in the molding process. For example, FIGS. 6K-6T illustrate cross-sectional views of various process operations in the fabrication of a polishing pad for polishing a semiconductor substrate and adapted for eddy current end-point detection, in accordance with an embodiment of the present invention.

Referring to FIGS. 6K-6O, a method of fabricating a polishing pad includes first forming a partially cured end-point detection region precursor on a support structure. For example, referring to FIGS. 6K and 6L, a support structure 699 is placed inside a first formation mold 602. In accordance with an embodiment of the present invention, support structure 699 is sized to conformal with the bottom of the first formation mold 602. In one embodiment, support structure 699 is composed of a non-flexible material, e.g., a brittle material such as a rigid epoxy board. In one embodiment, support structure 699 is composed of a material suitable to withstand temperatures of approximately 300 degrees Fahrenheit. In one embodiment, support structure 699 is composed of a material suitable to tolerate a high thermal budget since, in a specific embodiment, support structure 699 is recycled for repeated use in the molding process described in FIGS. 6K-6T. In an embodiment, support structure 699 is composed of a thermal insulator material to avoid any transfer of heat through support structure 699 during a molding process. In an embodiment, support structure 699 is composed of a chemically inert material and does not covalently bond with polyurethane materials during a curing process. In an embodiment, support structure 699 is composed of a material that exhibits negligible to no out-gassing upon heating.

Figure 6M:
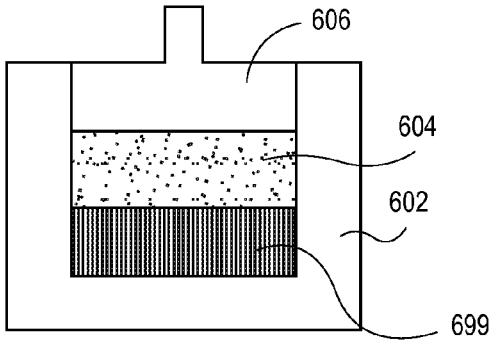
Figure 6N:
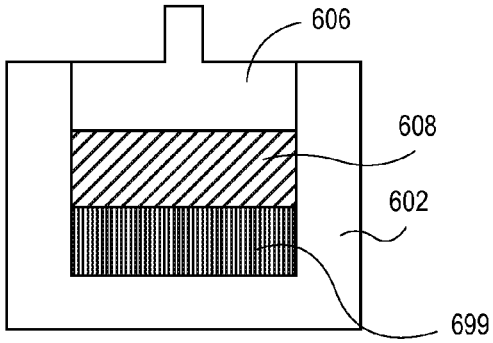
Figure 6O:
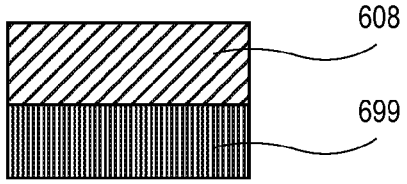

Referring to FIGS. 6M-6O, the first formation mold 602 is filled with a precursor mixture 604, above support structure 699, and a lid 606 of the first formation mold 602 is placed on top of the mixture 604. In an embodiment, with the lid 606 in place, the mixture 604 is heated under pressure to provide a partially cured body 608 (e.g., at least some extent of cross-linking and/or chain extension formed throughout the mixture 604, as depicted in FIG. 6N) disposed on support structure 699. Upon removal of the partially cured body 608 and coupled support structure 699 from the first formation mold 602, a partially cured end-point detection region precursor 608 is provided coupled to the support structure 699, as depicted in FIG. 6O. In an embodiment, a polymer film is adhered to the top surface of support structure 699 with a piece of two-sided tape prior to adding mixture 604 to the first formation mold 602. Thus, in an embodiment, the partially cured body 608 is coupled to support structure 699 by a polymer film and a piece of two-sided tape.

Figure 6P:
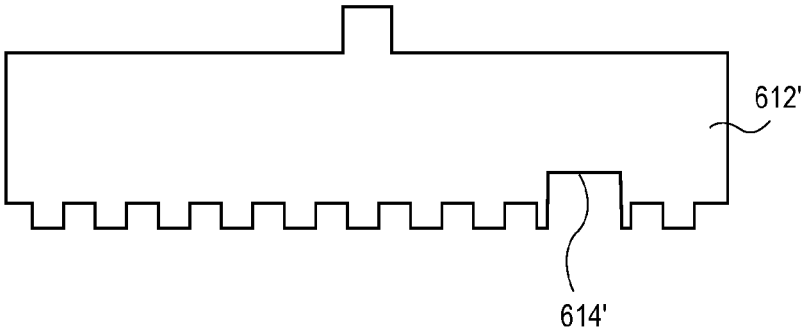
Figure 6Q:
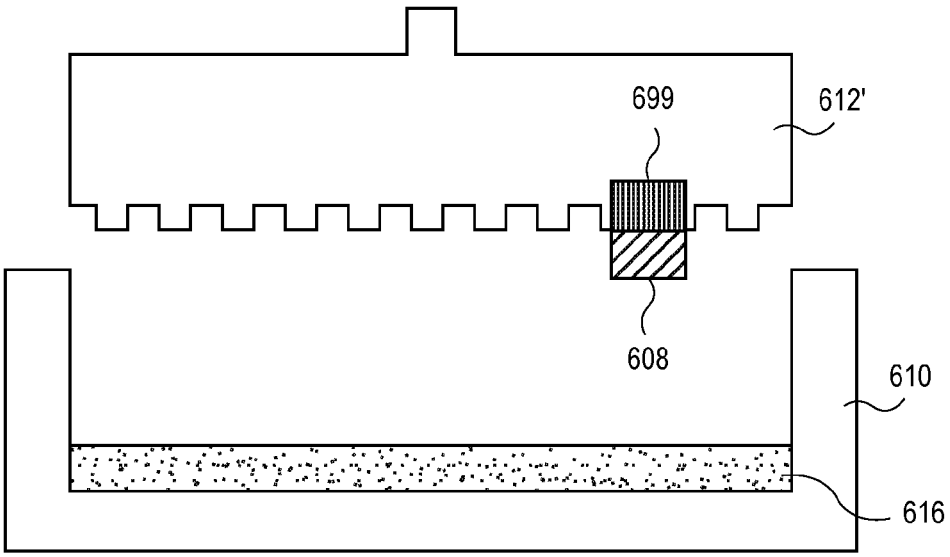

Referring to FIGS. 6P and 6Q, the partially cured end-point detection region precursor 608 and coupled support structure 699 are positioned in a receiving region 614' of a lid 612' of a second formation mold 610. In an embodiment, a polymer film is disposed between the partially cured end-point detection region precursor 608 and the support structure 699, e.g. with a first piece of two-sided tape, and a second piece of two-sided tape is used to couple the support structure 699 to a surface of the receiving region 614' of the lid 612'. A polishing pad precursor mixture 616 is formed in the second formation mold 610. In accordance with an embodiment of the present invention, the polishing pad precursor mixture 616 includes a polyurethane pre-polymer and a curative.

Figure 6R:
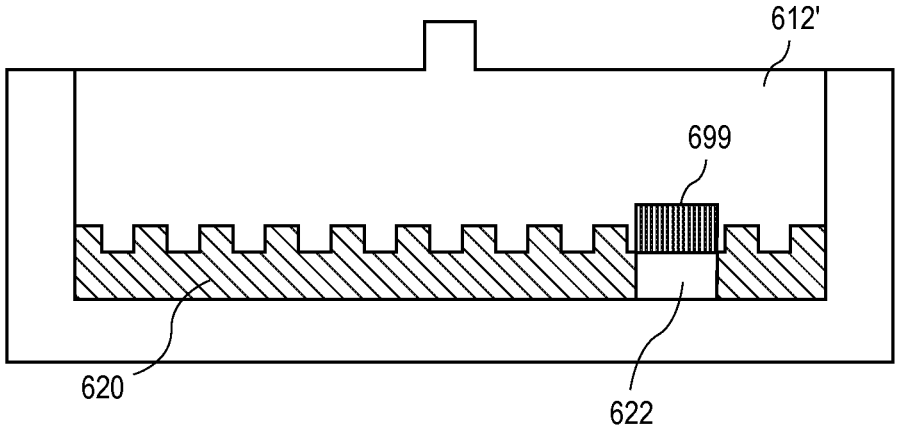

Referring to FIG. 6R, the partially cured end-point detection region precursor 608, as supported by support structure 699, is moved into the polishing pad precursor mixture 616 by lowering the lid 612' of the second formation mold 610. In an embodiment, the partially cured end-point detection region precursor 608 is moved to the very bottom surface of the second formation mold 610. The polishing pad precursor mixture 616 and the partially cured end-point detection region precursor 608, and thus support structure 699, are heated under pressure (e.g., with the lid 612' in place) to provide a molded homogeneous polishing body 620 cross-linked with an end-point detection region precursor 622.

Figure 6S:
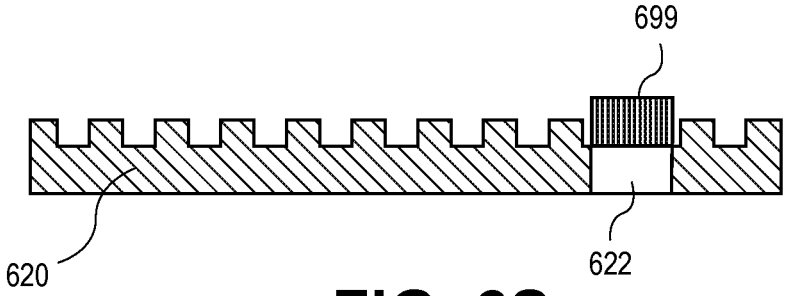

Referring to FIG. 6S, a polishing pad (or polishing pad precursor, if further curing is required) is removed from mold 610 to provide a molded homogeneous polishing body 620 with a cured end-point detection region precursor 622 disposed therein. However, in an embodiment, support structure 699 remains coupled to the cured end-point detection region precursor 622 after removal from formation mold 610, as depicted in FIG. 6S. It is noted that further curing through heating may be required and may be performed by placing the polishing pad in an oven and heating. Either way, a polishing pad is ultimately provided, wherein molded homogeneous polishing body 620 of the polishing pad has a polishing surface (top, grooved surface of FIG. 6S) and a back surface (bottom, flat surface of FIG. 6S), as well as support structure 699. Thus, in an embodiment, support structure 699 needs to be removed to provide a polishing pad, e.g., by removing support structure 699 and an adjoining two-sided tape from the cured end-point detection region precursor 622. In one embodiment, support structure 699 is removed and, subsequently, the cured end-point detection region precursor 622 is recessed, as described above in association with FIGS. 6I and 6J, to provide a polishing pad with a recessed end-point detection region.

Figure 6T:
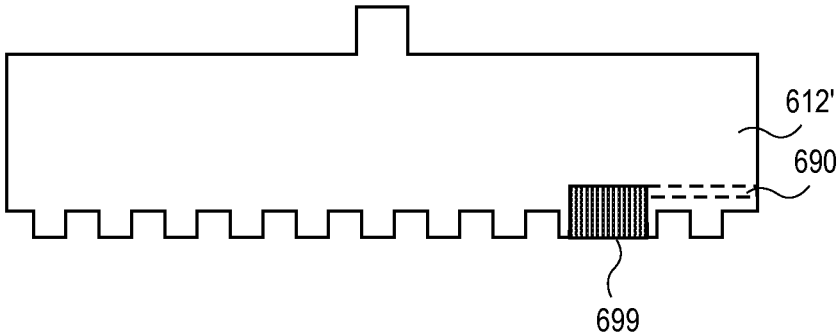

Referring to FIG. 6T, in another embodiment, support structure 699 remains coupled to the receiving region 614' of the lid 612' upon removal of the polishing pad from mold 610. That is, support structure 699 peels away from the end-point detection region precursor 620 when lid 612' is raised from the formation mold 610. In an embodiment, support structure 699 is readily removed by pulling support structure 699 from the receiving region 614'. However, in another embodiment, support structure 699 can prove difficult to remove from lid 612'. Thus, in one embodiment, an opening or vent 690 is provided in lid 612'. Upon removal of lid 612' from formation mold 610, air or an inert gas may be forced through opening 690 to eject support structure 699 from the receiving region 614'. In a specific embodiment, the support structure 699 is then re-used in a subsequent molding process.

In another aspect, a partially cured end-point detection region precursor may include a sacrificial layer, and the recessing is performed by removing the sacrificial layer. For example, FIGS. 7A-7C illustrate cross-sectional views of various process operations in the fabrication of a polishing pad for polishing a semiconductor substrate and adapted for eddy current end-point detection, in accordance with an embodiment of the present invention.

Figure 7A:
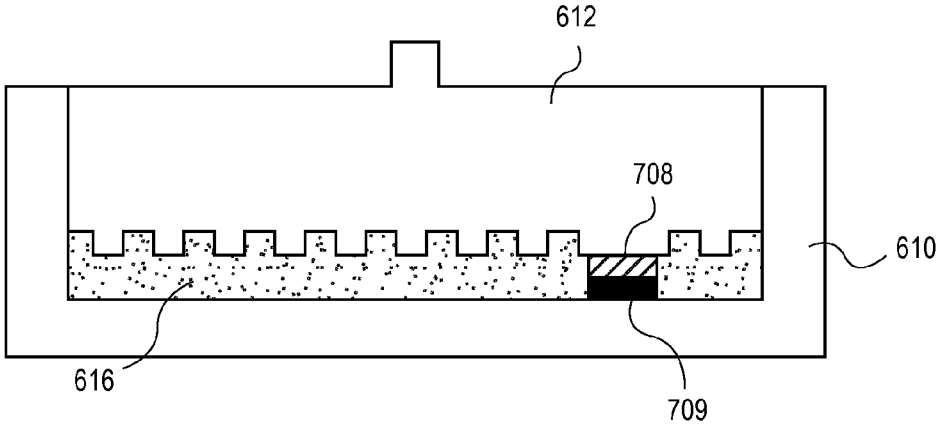
FIG. 7A-7D illustrate cross-sectional views of operations used in the fabrication of a polishing pad, in accordance with an embodiment of the present invention.

Referring to FIG. 7A, a partially cured end-point detection region precursor 708 is inserted into a polishing pad precursor mixture 616 by lowering the lid 612 of a formation mold 610 having the partially cured end-point detection region precursor 708 thereon. In an embodiment, however, different from partially cured end-point detection region precursor 608, the partially cured end-point detection region precursor 708 includes a sacrificial layer 709 disposed thereon. Thus, the partially cured end-point detection region precursor 708 is not inserted alone into the polishing pad precursor mixture 616 and then moved toward the bottom surface of the formation mold 610. Rather, sacrificial layer 709 is coupled to the partially cured end-point detection region precursor 708 prior to placing 708 on the lid 612 of formation mold 610. Then, together, the partially cured end-point detection region precursor 708 and the sacrificial layer 709 are moved toward the bottom surface of the formation mold 610, as depicted in FIG. 7A. Thus, the sacrificial layer 709 sits between the bottom of the formation mold and the partially cured end-point detection region precursor 708. In an embodiment, sacrificial layer 709 is composed of a composite that includes a layer of Mylar film as a component.

Figure 7B:
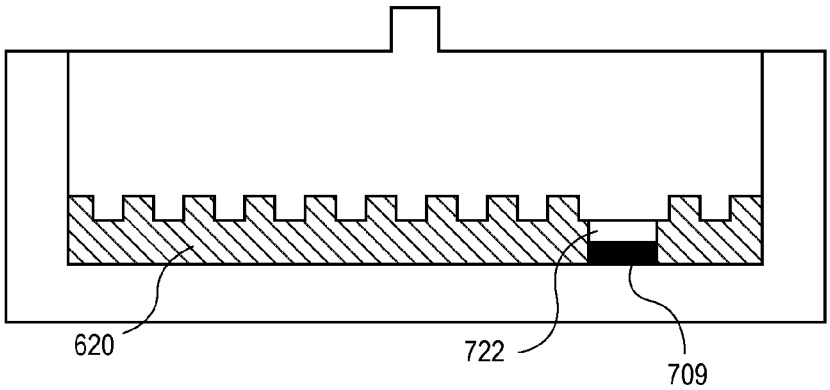
Figure 7C:
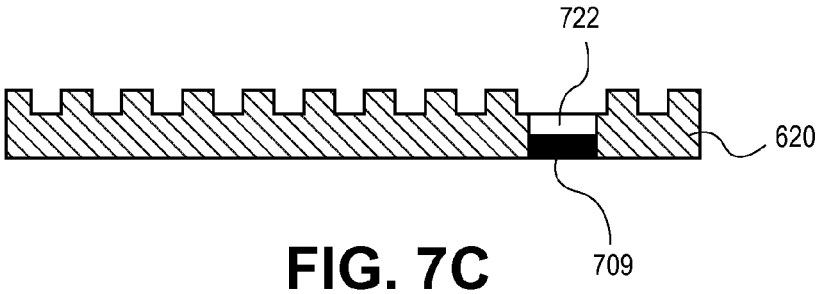
Figure 7D:
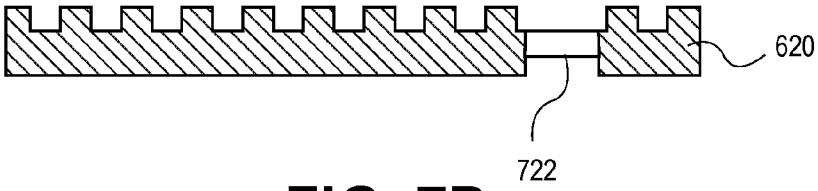

Referring to FIG. 7B, the polishing pad precursor mixture 616 and the partially cured end-point detection region precursor 708 are heated under pressure (e.g., with the lid 612 in place) to provide a molded homogeneous polishing body 620 covalently bonded with an end-point detection region 722. Referring to FIG. 7C, a polishing pad is removed from mold 610 to provide a molded homogeneous polishing body 620 with an end-point detection region 722 and the sacrificial layer 709 disposed therein. In accordance with an embodiment of the present invention, the recessing of an eddy current detection region of a polishing pad is achieved by removing the sacrificial layer 709, as depicted in FIG. 7D. In one embodiment, the entire end-point detection region 722 is thus recessed relative to the back surface of the molded homogeneous polishing body 620, as is also depicted in FIG. 7D.

In accordance with an embodiment of the present invention, the end-point detection region (e.g., 624 of FIG. 6I or 722 of FIG. 7D) is composed of a material different from the molded homogeneous polishing body, as described above and in association with FIGS. 1A and 1B, 2A and 2B, 3A, and 3B. For example, in one embodiment, the end-point detection region 624 or 722 is a local area transparency (LAT) region, as described in association with FIGS. 1A, 1B and 2A, 2B. In one embodiment, the end-point detection region 624 or 722 is an opaque region having a hardness different from the hardness of the molded homogeneous polishing body 620, as described in association with FIGS. 3A and 3B. In an embodiment, the molded homogeneous polishing body 620 is composed of a thermoset, closed cell polyurethane material. In an embodiment, the polishing surface of the molded homogeneous polishing body 620 includes a pattern of grooves disposed therein and formed from the lid of the second formation mold 610.

As described above briefly, in an embodiment, the end-point detection region 624 (or 722) and the molded homogeneous polishing body 620 may have different hardnesses. For example, in one embodiment, the molded homogeneous polishing body 620 has a hardness less than the hardness of the end-point detection region 624. In a specific embodiment, the molded homogeneous polishing body 620 has a hardness approximately in the range of Shore D 20-45, while the end-point detection region 624 has a hardness of approximately Shore D 60. Although the hardnesses may differ, covalent bonding and/or cross-linking between the end-point detection region 624 and the molded homogeneous polishing body 620 may still be extensive. For example, in accordance with an embodiment of the present invention, the difference in hardness of the molded homogeneous polishing body 620 and the end-point detection region 624 is Shore D 10 or greater, yet the extent of covalent bonding and/or cross-linking between the molded homogeneous polishing body 620 and the end-point detection region 624 is substantial.

Dimensions of a polishing pad and an end-point detection region disposed therein may vary according to desired application. For example, in one embodiment, the polishing pad is fabricated to accommodate an eddy current probe, and the molded homogeneous polishing body 620 is circular with a diameter approximately in the range of 75-78 centimeters, while the end-point detection region 624 has a length approximately in the range of 4-6 centimeters along a radial axis of the molded homogeneous polishing body 620, a width approximately in the range of 1-2 centimeters, and is positioned approximately in the range of 16-20 centimeters from the center of the molded homogeneous polishing body 620.

With respect to vertical positioning, the location of an end-point detection region in a polishing body may be selected for particular applications, and may also be a consequence of the formation process. For example, by including an end-point detection region in a polishing body via a molding process, the positioning and accuracy achievable may be significantly more tailored than, e.g., a process in which a polishing pad is cut after formation and a window insert is added after the formation of the polishing pad. In an embodiment, by using a molding process as described above, the end-point detection region 624 is included in the molded homogeneous polishing body 620 to be planar with the bottoms of the troughs of a grooved surface of the molded homogeneous polishing body 620. In a specific embodiment, by including the end-point detection region 624 to be planar with the bottoms of the troughs of a grooved surface of the polishing body, the end-point detection region 624 does not interfere with CMP processing operations throughout the life of a polishing pad fabricated from the molded homogeneous polishing body 620 and the end-point detection region 624.

As described above, a polishing pad adapted for eddy current detection may be fabricated in a molding process. However, the polishing pad need not include an LAT or other, separate and different, material region. FIGS. 8A-8F illustrate cross-sectional views of various process operations in the fabrication of a polishing pad for polishing a semiconductor substrate and adapted for eddy current end-point detection, in accordance with an embodiment of the present invention.

Figure 8A:
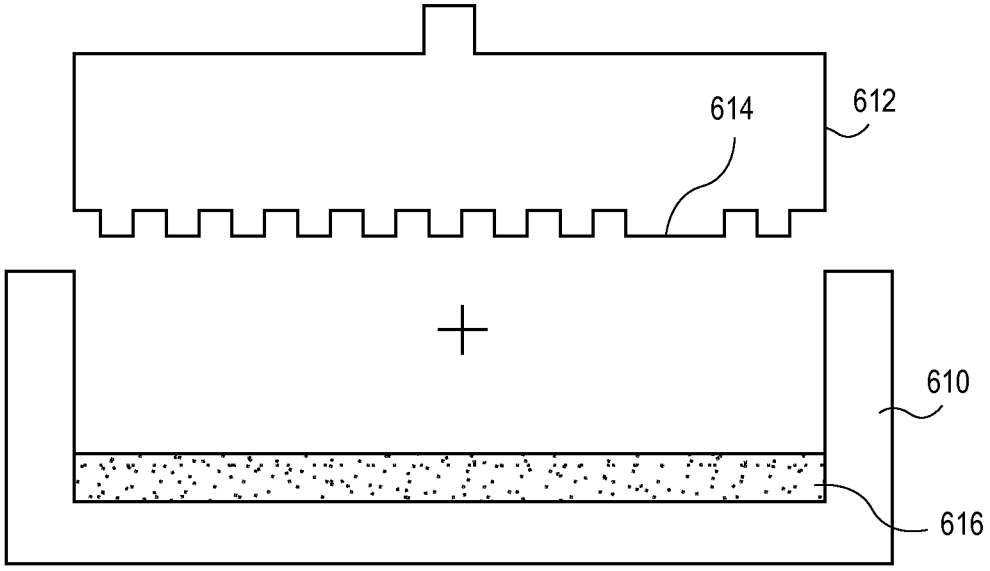
FIG. 8A-8F illustrate cross-sectional views of operations used in the fabrication of a polishing pad, in accordance with an embodiment of the present invention.
Figure 8B:
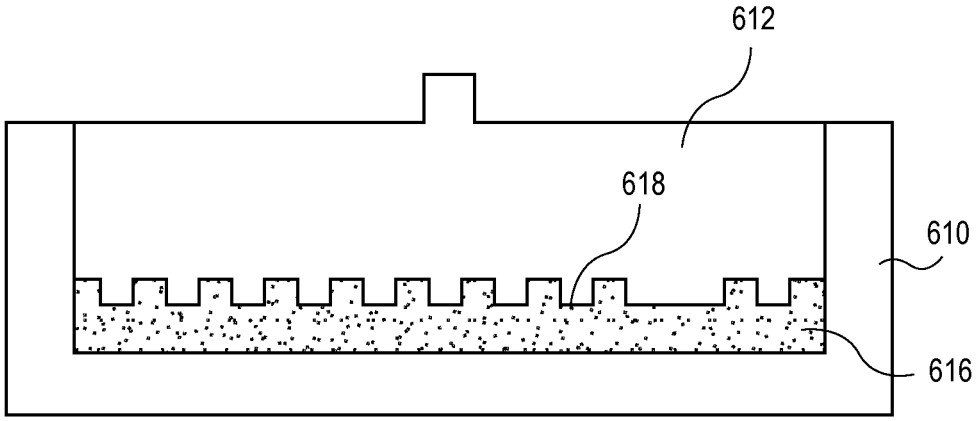

Referring to FIG. 8A, a method of fabricating a polishing pad includes forming a polishing pad precursor mixture 616 in a formation mold 610. Referring to FIGS. 8A and 8B, a lid 612 of the formation mold 610 is positioned into the polishing pad precursor mixture 616. The lid 612 includes a pattern of grooves 618 disposed thereon. The pattern of grooves 618 has an interrupted region 614, where the pattern is different or somewhat isolated from the majority of grooved 618, as is described in more detail below.

Figure 8C:
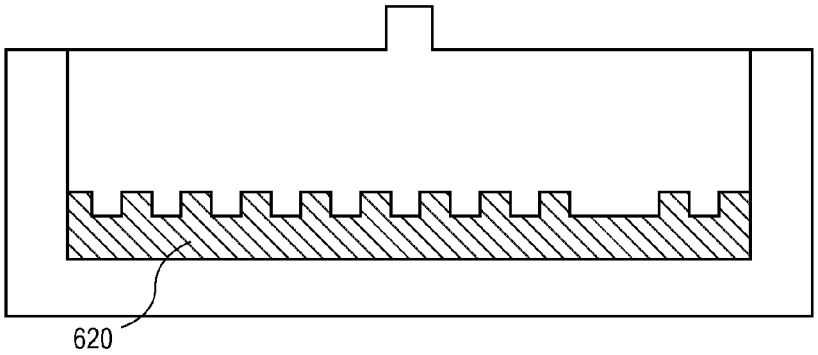
Figure 8D:
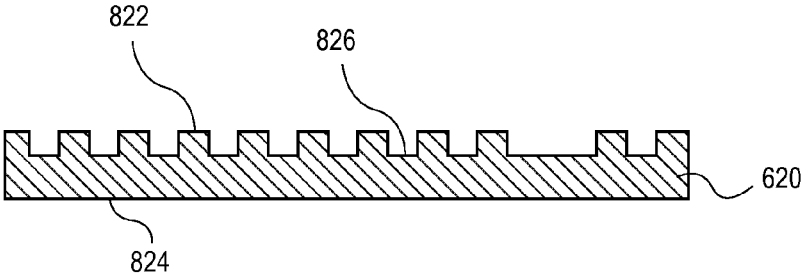

Referring to FIG. 8C, the polishing pad precursor mixture 616 is heated to provide a molded homogeneous polishing body 620. Referring to FIG. 8D, the molded homogeneous polishing body 620 is removed from formation mold 610 to provide a polishing pad (or a precursor to a polishing pad, if further heating or curing is required after the molding process). The polishing pad, composed of molded homogeneous polishing body 620, includes a polishing surface 822 and a back surface 824. In accordance with an embodiment of the present invention, the pattern of grooves 618, including interrupted region 614, from the lid 612 of formation mold 610 is disposed in the polishing surface 822, as depicted in FIG. 8D. The pattern of grooves disposed in polishing surface 822 has a bottom depth 826. In an embodiment, the molded homogeneous polishing body 620 is composed of a thermoset, closed cell polyurethane material.

Figure 8E:
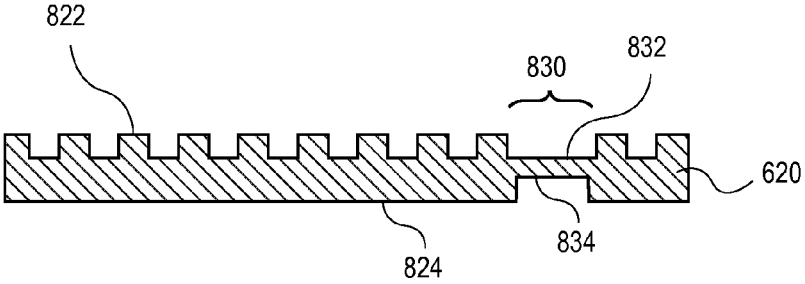
Figure 8F:
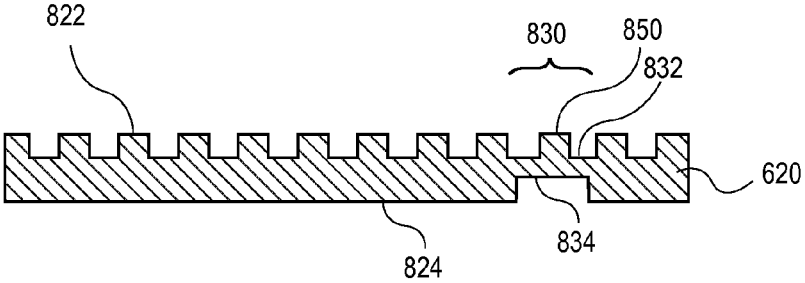

Referring to FIGS. 8E and 8F, an end-point detection region 830 is provided in the molded homogeneous polishing body 620. The end-point detection region has a first surface 832 oriented with the polishing surface 822, and a second surface 834 oriented with the back surface of the molded homogeneous polishing body 620. At least a portion of the first surface 832 is co-planar with the bottom depth 826 of the pattern of grooves. For example, in an embodiment, the entire first surface 832 is co-planar with the bottom depth 826 of the pattern of grooves, as depicted in FIG. 8E. Additionally, the second surface 834 is recessed into the molded homogeneous polishing body 620 relative to the back surface 824, as is also depicted in FIG. 8E. In an embodiment, providing the end-point detection region 830 is performed by routing out a portion of the molded homogeneous polishing body 620. In an embodiment, the molded homogeneous polishing body 620, including the end-point detection region 830, is opaque.

In accordance with an embodiment of the present invention, as mentioned above, the polishing surface 822 includes an interrupted region of its pattern of grooves. The interrupted region corresponds to interrupted region 614 in the lid 612 of formation mold 610. In one embodiment, as depicted in FIGS. 8A and 8E, interrupted region 614 is entirely flat and planar with bottom of the lid 612. As such, the entire first surface 832 of the end-point detection region 830 is essentially co-planar with the bottom depth 826 of the pattern of grooves in polishing surface 822, as is described in association with the polishing pad of FIGS. 4A and 4B. However, in an alternative embodiment, the first surface of the end-point detection region 830 includes a second pattern of grooves 850 having a depth essentially co-planar with the bottom depth of the pattern of grooves disposed in the polishing surface 822 of the molded homogeneous polishing body 820. Such an alternative embodiment is depicted in FIG. 8F. Polishing pads consistent with this embodiment are described above in association with FIGS. 5A and 5B. In a specific embodiment, individual grooves of both the pattern of grooves (of polishing surface 822) and the second pattern of grooves (of the interrupted region) are spaced apart by a width, and the second pattern of grooves is offset from the first pattern of grooves by a distance greater than the width, as is also described in association with described above in association with FIGS. 5A and 5B.

In another aspect of the present invention, an end-point detection region in a molded homogeneous polishing body is formed by removing a sacrificial layer. For example, FIGS. 9A-9F illustrate cross-sectional views of various process operations in the fabrication of a polishing pad with an end-point detection region provided therein by removing a sacrificial layer embedded in the molded homogeneous polishing body, in accordance with an embodiment of the present invention.

Figure 9A:
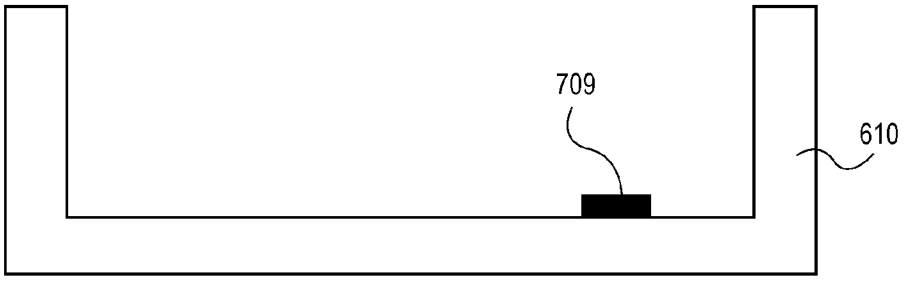
FIG. 9A-9F illustrate cross-sectional views of operations used in the fabrication of a polishing pad, in accordance with an embodiment of the present invention.
Figure 9B:
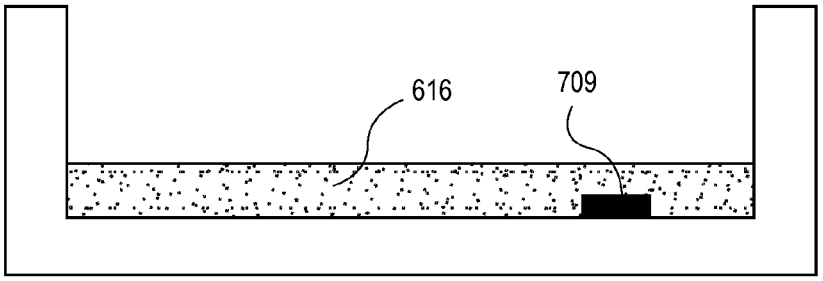
Figure 9C:
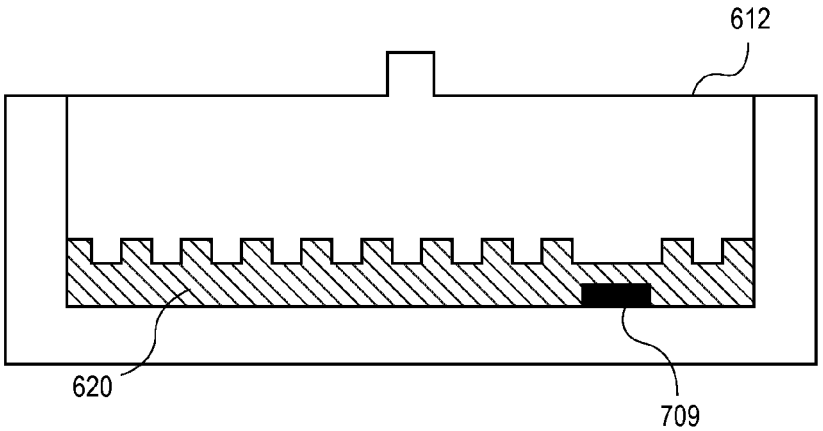

Referring to FIG. 9A, a sacrificial layer 709 is disposed at the bottom of a formation mold 610. For example, in one embodiment, sacrificial layer 709 is inserted into a formation mold prior to addition of polishing pad ingredients to the mold. In a specific embodiment, sacrificial layer 709 is composed of a layer of Mylar film. Referring to FIG. 9B, a polishing pad precursor mixture is dispensed into formation mold 610, over the sacrificial layer 709. Referring to FIG. 9C, with a lid 612 in place in formation mold 610, the polishing pad precursor mixture 616 is heated to provide a molded homogeneous polishing body 620, as described in association with FIG. 8C. However, the sacrificial layer 709 disposed at the bottom of the formation mold 610 remains during molding of 620.

Figure 9D:
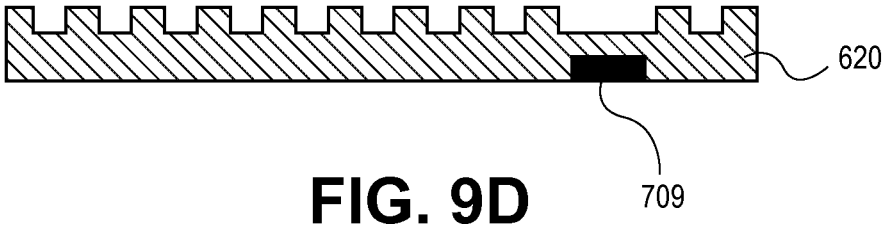
Figure 9E:
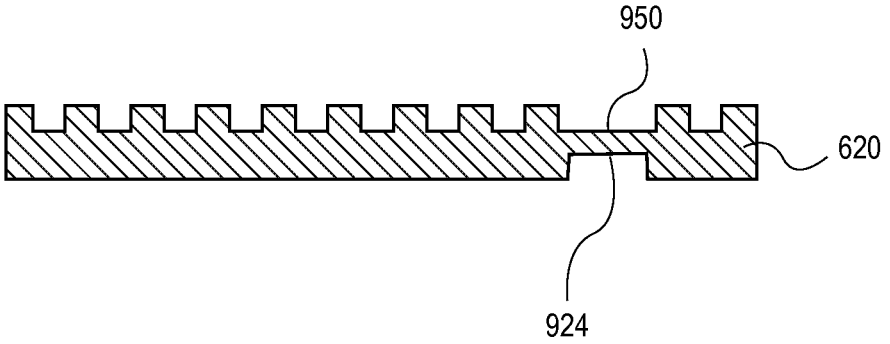
Figure 9F:
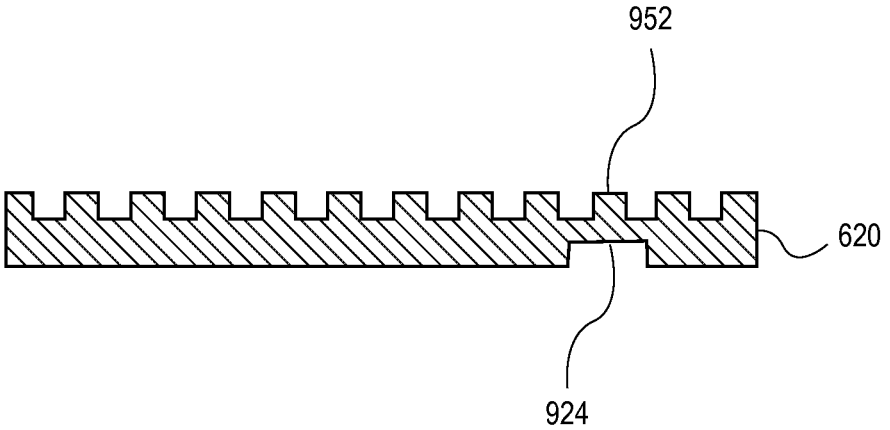

Referring to FIG. 9D, the molded homogeneous polishing body 620 is removed from formation mold to provide a polishing pad (or a precursor to a polishing pad, if further heating or curing is required after the molding process) with sacrificial layer 709 disposed therein. Referring to FIGS. 9E and 9F, an end-point detection region 924 is provided in the molded homogeneous polishing body 620 upon removal of sacrificial layer 709. Thus, in accordance with an embodiment of the present invention, the recessing of an eddy current detection region of a polishing pad is achieved by removing the sacrificial layer 709 co-planar with the back-surface of a polishing pad. In one embodiment, then, the entire end-point detection region 924 is recessed relative to the back surface of the molded homogeneous polishing body 620, as is depicted in FIGS. 9E and 9F. In one embodiment, the entire top surface 950 of end-point detection region 924 is recessed and flat, as depicted in FIG. 9E. In another embodiment, however, a second set of grooves 952, interrupted from the grooves of the polishing surface of 620, is disposed on the top surface of end-point detection region 924, as depicted in FIG. 9F.

In yet another embodiment, a recessed region for a polishing pad may be fabricated by placing, or incorporating, a raised feature at the bottom of a mold used to form the polishing pad. For example, referring again to FIGS. 9A-9C, instead of a sacrificial layer 709, the blackened region may be a permanent or semi-permanent feature built into the formation mold 610. That is, the feature does not transfer with a fabricated polishing pad, in contrast with the sacrificial layer 709 that is transferred from the mold with a fabricated polishing pad (e.g., as was described in association with FIG. 9D). In such a case, in one embodiment, a polishing pad composed of homogeneous polishing body 620, such as is shown in FIGS. 9E and 9F, is formed directly in the formation mold, without the need for intermediate removal of a sacrificial layer (as is otherwise described in association with FIG. 9D). In another embodiment, permanent or semi-permanent feature built into the formation mold is used together with a dual material pad fabrication, such as for fabricating polishing pads such as those described in association with FIGS. 1A, 2A, 3A and 3B.

Polishing pads described herein may be suitable for use with chemical mechanical polishing apparatuses equipped with an eddy current end-point detection system. For example, FIG. 10 illustrates an isometric side-on view of a polishing apparatus compatible with a polishing pad adapted for eddy current end-point detection, in accordance with an embodiment of the present invention.

Figure 10:
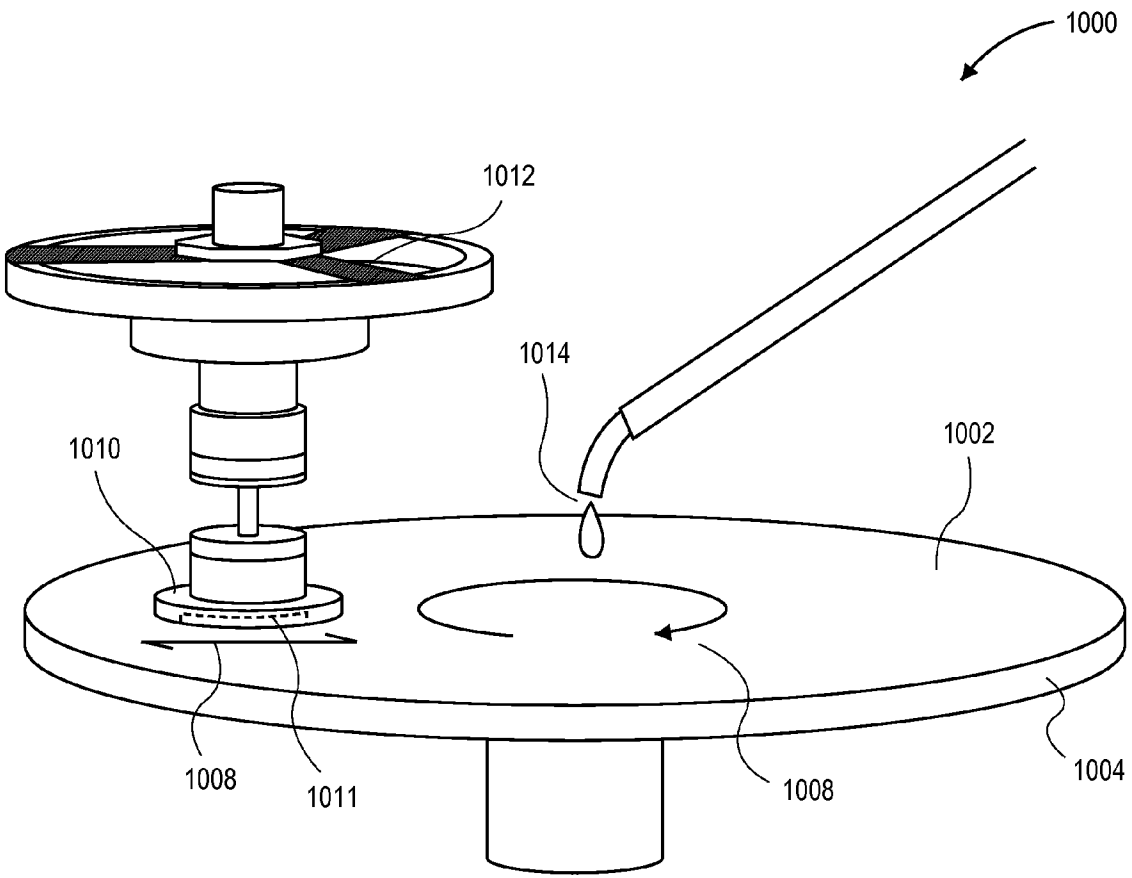
FIG. 10 illustrates an isometric side-on view of a polishing apparatus compatible with a polishing pad for eddy current end-point detection, in accordance with an embodiment of the present invention.

Referring to FIG. 10, a polishing apparatus 1000 includes a platen 1004. The top surface 1002 of platen 1004 may be used to support a polishing pad for eddy current end-point detection. Platen 1004 may be configured to provide spindle rotation 1006 and slider oscillation 1008. A sample carrier 1010 is used to hold, e.g., a semiconductor wafer 1011 in place during polishing of the semiconductor wafer with a polishing pad. Sample carrier 1010 is further supported by a suspension mechanism 1012. A slurry feed 1014 is included for providing slurry to a surface of a polishing pad prior to and during polishing of the semiconductor wafer.

In an aspect of the present invention, a polishing pad adapted for eddy current end-point detection is provided for use with a polishing apparatus similar to polishing apparatus 1000. For example, FIG. 11 illustrates a cross-sectional view of a polishing apparatus with eddy current end-point detection system and a polishing pad compatible with the eddy current end-point detection system, in accordance with an embodiment of the present invention.

Figure 11:
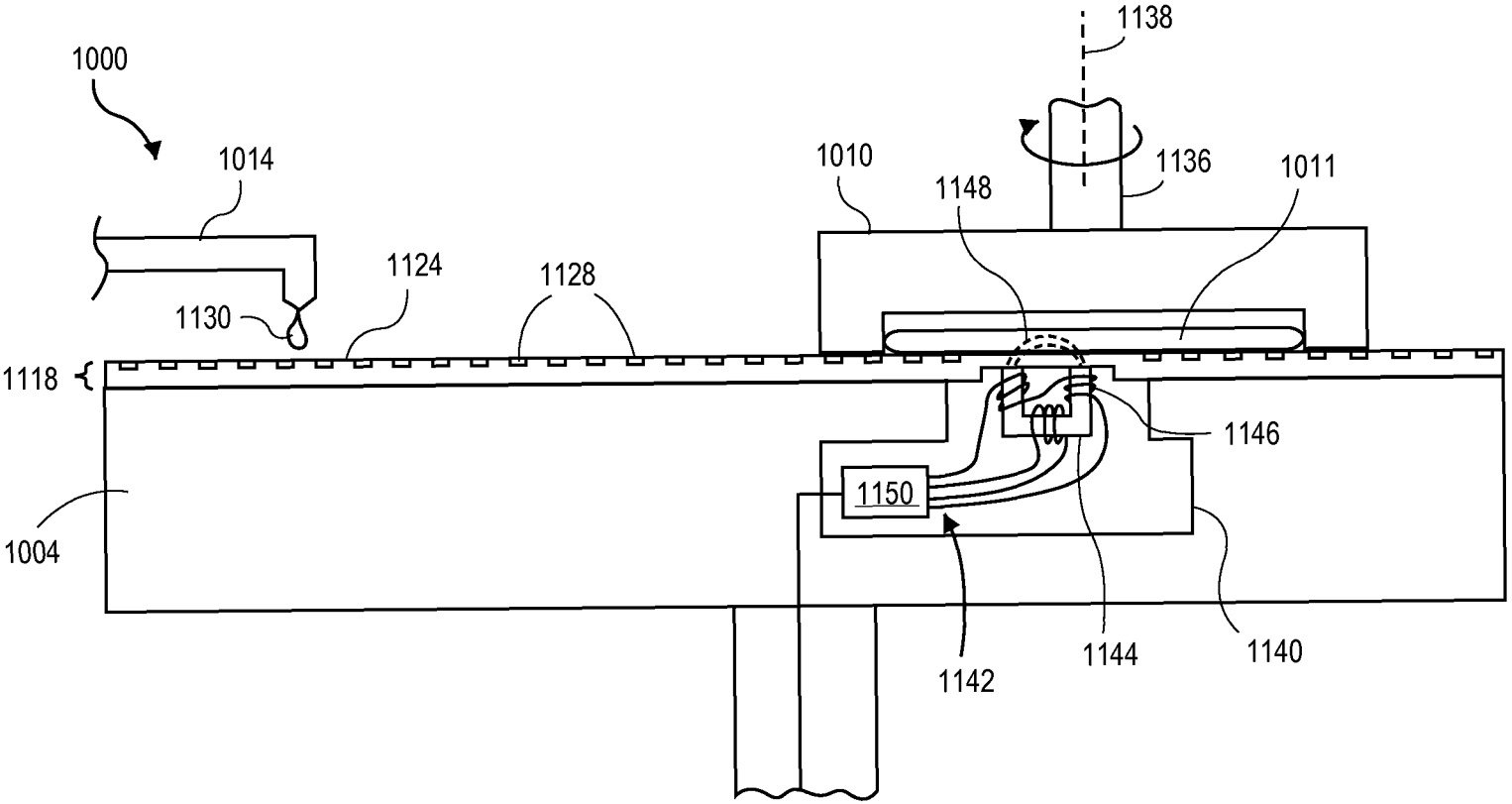
FIG. 11 illustrates a cross-sectional view of a polishing apparatus with eddy current end-point detection system and a polishing pad compatible with the eddy current end-point detection system, in accordance with an embodiment of the present invention.

Referring to FIG. 11, a polishing station 1000 includes a rotatable platen 1004 on which is placed a polishing pad 1118. The polishing pad 1118 provides a polishing surface 1124. At least a portion of the polishing surface 1124 can have grooves 1128 for carrying slurry. The polishing station 1000 can also include a polishing pad conditioner apparatus to maintain the condition of the polishing pad so that it will effectively polish substrates. During a polishing operation, a chemical mechanical polishing slurry 1130 is supplied to the surface of polishing pad 1118 by a slurry supply port or combined slurry/rinse arm 1014. The substrate 1011 is held against the polishing pad 1118 by a carrier head 1010. The carrier head 1010 is suspended from a support structure, such as a carousel, and is connected by a carrier drive shaft 1136 to a carrier head rotation motor so that the carrier head can rotate about an axis 1138.

A recess 1140 is formed in platen 1004, and an in-situ monitoring module 1142 fits into the recess 1140. The in-situ monitoring module 1142 can include an in-situ eddy current monitoring system with a core 1144 positioned in the recess 1140 to rotate with the platen 1004. Drive and sense coils 1146 are wound the core 1144 and are connected to a controller 1150. In operation, an oscillator energizes the drive coil to generate an oscillating magnetic field 1148 that extends through the body of core 1144. At least a portion of magnetic field 1148 extends through the polishing pad 1118 toward the substrate 1011. If a metal layer is present on the substrate 1011, the oscillating magnetic field 1148 will generate eddy currents.

The eddy current produces a magnetic flux in the opposite direction to the induced field, and this magnetic flux induces a back current in the primary or sense coil in a direction opposite to the drive current. The resulting change in current can be measured as change in impedance of the coil. As the thickness of the metal layer changes, the resistance of the metal layer changes. Therefore, the strength of the eddy current and the magnetic flux induced by the eddy current also change, resulting in a change to the impedance of the primary coil. By monitoring these changes, e.g., by measuring the amplitude of the coil current or the phase of the coil current with respect to the phase of the driving coil current, the eddy current sensor monitor can detect the change in thickness of the metal layer.

Referring again to FIG. 11, in accordance with an embodiment of the present invention, when the polishing pad 1118 is secured to the platen 1004, a thin section fits over the recess 1140 in the plate and over a portion of the core and/or coil that projects beyond the plane of the top surface of the platen 1004. By positioning the core 1142 closer to the substrate 1112, there is less spread of the magnetic fields, and spatial resolution can be improved. Assuming that the polishing pad 1011 is not being used with an optical end-point monitoring system, then, in one embodiment, the entire polishing layer, including the portion over the recess, can be opaque. However, in another embodiment, the portion over the recess is transparent to aid with positioning of the polishing pad on a platen.

In accordance with an embodiment of the present invention, a problem addressed herein includes situations where eddy current end-point detection hardware includes a sensor that rises above the plane of the platen by about 0.070 inches, so that the sensor can be brought to an optimal distance from the wafer surface. This situation, however, may cause some problems in the design and performance of polishing pad, to which embodiments of the present invention may provide advantageous solutions. In one embodiment, the polishing pad is designed to accommodate an eddy current sensor, typically by means of a recess formed in the backside of the polishing pad. In a specific embodiment, a recess approximately 0.080 inches deep in a polishing pad is used for this purpose.

In an aspect of the present invention, a polishing pad designed to accommodate an eddy current end-point detection system, such as the polishing pads described in the various embodiments above, is adhered to platen 1004 by an adhesive surface. For example, in an embodiment, an adhesive with no carrier film (i.e., a transfer adhesive) is used to adhesively couple a polishing pad to platen 1004. Since, in such cases, no permanent carrier film is transferred with the pad to the platen, an opening need not be cut into a temporary or sacrificial release liner removed from the polishing pad prior to transferring to the platen. In one embodiment, a temporary or sacrificial release liner is removed from a polishing pad, leaving an adhesive membrane. Any portion of the membrane that crosses a recess in the polishing pad (such as a recess formed to accommodate an eddy current detection system) will either stay with the release liner or it will remain as a membrane across the opening of the recess. In the latter case, that portion of the membrane may need to be removed from across the opening of the recess before mounting the polishing pad on the platen. In an embodiment, neither the sacrificial release liner nor the adhesive membrane remaining on the polishing pad is a two-sided tape.

Thus, polishing pads for polishing semiconductor substrates using eddy current end-point detection have been disclosed. In accordance with an embodiment of the present invention, a polishing pad for polishing a semiconductor substrate includes a molded homogeneous polishing body. The molded homogeneous polishing body has a polishing surface and a back surface. The polishing pad also includes an end-point detection region disposed in and covalently bonded with the molded homogeneous polishing body. The end-point detection region is composed of a material different from the molded homogeneous polishing body, at least a portion of which is recessed relative to the back surface of the molded homogeneous polishing body. In accordance with another embodiment of the present invention, a polishing pad for polishing a semiconductor substrate includes a molded homogeneous polishing body having a polishing surface and a back surface. A pattern of grooves is disposed in the polishing surface, the pattern of grooves having a bottom depth. The polishing pad also includes an end-point detection region formed in the molded homogeneous polishing body. The end-point detection region has a first surface oriented with the polishing surface and a second surface oriented with the back surface. At least a portion of the first surface is co-planar with the bottom depth of the pattern of grooves and interrupts the pattern of grooves. The second surface is recessed into the molded homogeneous polishing body relative to the back surface.

What is claimed is:

1. A polishing pad for polishing a semiconductor substrate, the polishing pad comprising:

a molded homogeneous polishing body comprising a polishing surface and a back surface; and an end-point detection region disposed in and covalently bonded with the molded homogeneous polishing body wherein atoms of the end-point detection region share electrons with atoms of the homogeneous polishing body, the end-point detection region comprising a material different from the molded homogeneous polishing body, at least a portion of which is recessed relative to the back surface of the molded homogeneous polishing body.

2. The polishing pad of claim 1, wherein at least a portion of the end-point detection region is recessed relative to the polishing surface of the molded homogeneous polishing body.

3. The polishing pad of claim 1, wherein the end-point detection region is a local area transparency (LAT) region.

4. The polishing pad of claim 3, wherein the hardness of the end-point detection region is greater than the hardness of the molded homogeneous polishing body.

5. The polishing pad of claim 1, wherein the end-point detection region is an opaque region having a hardness different from the hardness of the molded homogeneous polishing body.

6. The polishing pad of claim 5, wherein the hardness of the end-point detection region is greater than the hardness of the molded homogeneous polishing body.

7. The polishing pad of claim 5, wherein the hardness of the end-point detection region is less than the hardness of the molded homogeneous polishing body.

8. The polishing pad of claim 1, wherein the entire end-point detection region is recessed relative to the back surface of the molded homogeneous polishing body.

9. The polishing pad of claim 1, wherein only an inner portion of the end-point detection region is recessed relative to the back surface of the molded homogeneous polishing body.

10. The polishing pad of claim 1, wherein the molded homogeneous polishing body comprises a thermoset, closed cell polyurethane material.

11. The polishing pad of claim 1, wherein the polishing surface comprises a pattern of grooves disposed in the polishing surface.

* * * * *